US010332331B2

(12) United States Patent
Li et al.

(10) Patent No.: US 10,332,331 B2
(45) Date of Patent: Jun. 25, 2019

(54) MODULAR VENDING MACHINE

(71) Applicant: PEPSICO, INC., Purchase, NY (US)

(72) Inventors: Xuejun Li, Pleasantville, NY (US); Emad Jafa, Brewster, NY (US); Joshua Drake, Walcott, IA (US); Michael D. Clapper, Newton, IA (US); Brian D. Clark, Ankeny, IA (US); Victor Jon Fageroos, Urbandale, IA (US); Steven Dean Larson, Newton, IA (US); Brian Ness, Newton, IA (US); Michael Chiugu, Newton, IA (US); Chad Rorabaugh, Colfax, IA (US); Brian Douglas Ripley, Webster City, IA (US); Dean Minar, Purchase, NY (US)

(73) Assignee: PepsiCo, Inc., Purchase, NY (US)

( * ) Notice: Subject to any disclaimer, the term of this patent is extended or adjusted under 35 U.S.C. 154(b) by 68 days.

(21) Appl. No.: 15/388,862

(22) Filed: Dec. 22, 2016

(65) Prior Publication Data

US 2018/0108203 A1 Apr. 19, 2018

Related U.S. Application Data

(60) Provisional application No. 62/408,058, filed on Oct. 14, 2016.

(51) Int. Cl.

| | |
|---|---|
| ***G07F 11/00*** | (2006.01) |
| ***G07F 9/10*** | (2006.01) |
| ***G07F 11/16*** | (2006.01) |
| ***G07F 11/10*** | (2006.01) |
| ***G07F 11/24*** | (2006.01) |

(52) U.S. Cl.

CPC ..... *G07F 9/10* (2013.01); *G07F 11/10* (2013.01); *G07F 11/165* (2013.01); *G07F 11/24* (2013.01)

(58) Field of Classification Search

CPC ..... G07F 11/165; G07F 17/0092

See application file for complete search history.

(56) References Cited

U.S. PATENT DOCUMENTS

| | | | |
|---|---|---|---|
| 485,279 | A | 11/1892 | Jaques |
| 3,128,013 | A | 4/1964 | Holstein et al. |
| 3,591,045 | A | 7/1971 | Sturrock |
| 4,108,333 | A | 8/1978 | Falk et al. |
| 4,498,570 | A | 2/1985 | King et al. |
| 4,671,425 | A | 6/1987 | Knoll |

(Continued)

FOREIGN PATENT DOCUMENTS

| | | |
|---|---|---|
| GB | 2088610 | 12/1984 |
| GB | 2517800 A | 3/2015 |

(Continued)

OTHER PUBLICATIONS

Bakos, Yannis and Erik Brynjolfsson, "Bundling Information Goods: Pricing, Profits and Efficiency" (1999), 28 pages.

(Continued)

*Primary Examiner* — Timothy R Waggoner

(74) *Attorney, Agent, or Firm* — Sterne, Kessler, Goldstein & Fox P.L.L.C.

(57) ABSTRACT

A modular vending machine is provided. The modular vending machine can include a central module having a pickup area and one or more product storage cabinets.

14 Claims, 24 Drawing Sheets

(56) References Cited

U.S. PATENT DOCUMENTS 4,679,150 A 7/1987 Hayashi et al.
4,757,915 A 7/1988 Albright et al.
5,144,879 A 9/1992 Alessi
5,445,287 A 8/1995 Center et al.
5,450,938 A 9/1995 Rademacher
RE35,649 E 11/1997 Baer
5,791,512 A 8/1998 Kanatsuka
D416,048 S 11/1999 Kovens et al.
D424,041 S 5/2000 Tambata
6,059,142 A 5/2000 Wittern, Jr. et al.
6,112,497 A 9/2000 Credle, Jr.
6,199,720 B1 3/2001 Rudick et al.
6,223,163 B1 4/2001 Van Luchene
6,230,930 B1 * 5/2001 Sorensen ..... G07F 11/16 221/131
6,247,610 B1 * 6/2001 Ziesel ..... G07F 9/02 221/119
D444,794 S 7/2001 Nashida et al.
6,253,954 B1 7/2001 Yasaka
6,286,715 B1 9/2001 Ziesel et al.
6,328,180 B1 12/2001 Sorensen et al.
D456,028 S 4/2002 Sakata
6,412,654 B1 7/2002 Cleeve
6,367,653 B1 8/2002 Ruskin et al.
6,513,677 B1 2/2003 Sorensen et al.
D472,902 S 4/2003 Nashida et al.
6,556,889 B2 4/2003 Rudick et al.
D475,064 S 5/2003 Nashida et al.
6,575,363 B1 6/2003 Leason et al.
6,582,037 B1 6/2003 Rudick et al.
D485,279 S 1/2004 Decombe
D497,617 S 10/2004 Decombe et al.
6,808,082 B2 10/2004 Ohkubo
6,879,332 B2 4/2005 Decombe
6,888,554 B1 5/2005 Decombe
D506,474 S 6/2005 Gildred
D513,511 S 1/2006 Decombe
7,016,882 B2 3/2006 Afeyan et al.
7,036,093 B2 4/2006 Decombe
7,092,892 B1 8/2006 Sobalvarro et al.
D528,556 S 9/2006 Decombe
D545,323 S 6/2007 Decombe
D545,324 S 6/2007 Decombe
7,266,423 B2 9/2007 Simmons
7,290,223 B2 10/2007 Decombe
7,292,991 B2 11/2007 Peressini et al.
7,292,997 B2 11/2007 Kuwahara
7,347,364 B2 3/2008 Walker et al.
D571,821 S 6/2008 Amacker
D575,310 S 8/2008 Bruzelius et al.
7,415,426 B2 8/2008 Williams et al.
7,430,531 B1 9/2008 Snyder
D580,450 S 11/2008 Chen et al.
D580,946 S 11/2008 Chen et al.
7,451,891 B2 11/2008 Carter et al.
D589,528 S 3/2009 Koh
7,499,769 B2 3/2009 Walker et al.
D594,021 S 6/2009 Ball et al.
D601,573 S 10/2009 Arnell
D601,574 S 10/2009 Arnell
D601,575 S 10/2009 Arnell
D601,576 S 10/2009 Arnell
D601,577 S 10/2009 Arnell
D602,497 S 10/2009 Arnell
D606,089 S 12/2009 Lal
7,711,658 B2 5/2010 Tedesco et al.
7,726,562 B2 6/2010 Walker et al.
7,734,371 B2 6/2010 Garneau, III
7,756,746 B2 7/2010 Walker et al.
D622,733 S 8/2010 Lal
7,698,168 B2 8/2010 Nagata et al.
7,823,750 B2 11/2010 Carter et al.
7,826,923 B2 11/2010 Walker et al.
7,837,059 B2 11/2010 Hieb et al.
7,865,265 B2 1/2011 Walker et al.
7,885,852 B2 2/2011 Banerjee et al.
7,904,199 B2 3/2011 Carter et al.
7,912,581 B2 3/2011 Walker et al.
7,958,066 B2 6/2011 Pinckney et al.
D643,043 S 8/2011 Loken et al.
8,028,822 B2 10/2011 Braunstein
8,032,481 B2 10/2011 Pinckney et al.
8,036,774 B2 10/2011 Blust et al.
8,041,453 B2 10/2011 Walker et al.
8,068,933 B2 11/2011 Walker et al.
D655,713 S 3/2012 Ray et al.
D655,714 S 3/2012 Ray et al.
D655,715 S 3/2012 Ray et al.
D655,716 S 3/2012 Ray et al.
D658,203 S 4/2012 Hally et al.
8,162,174 B2 4/2012 Hieb et al.
8,200,535 B1 6/2012 Reddin et al.
8,201,736 B2 6/2012 Doglioni Majer
8,234,171 B2 7/2012 Sidio et al.
8,244,564 B2 8/2012 Selinger et al.
8,340,815 B2 12/2012 Peters et al.
8,392,019 B2 3/2013 Segal et al.
8,438,065 B2 5/2013 Sidio et al.
8,469,230 B2 6/2013 Perkins et al.
8,490,050 B2 7/2013 Crider et al.
8,521,605 B2 8/2013 Seki et al.
8,534,494 B2 9/2013 Black, Jr. et al.
D692,914 S 11/2013 Gerssen et al.
D696,264 S 12/2013 d'Amore et al.
D696,265 S 12/2013 d'Amore et al.
D696,266 S 12/2013 d'Amore et al.
8,620,472 B2 12/2013 Mockus et al.
8,678,232 B2 3/2014 Mockus et al.
D701,875 S 4/2014 d'Amore et al.
D701,876 S 4/2014 d'Amore et al.
D702,247 S 4/2014 d'Amore et al.
D702,698 S 4/2014 d'Amore et al.
D702,699 S 4/2014 d'Amore et al.
D703,681 S 4/2014 d'Amore et al.
8,700,493 B2 4/2014 Cao
8,712,585 B2 4/2014 Bruck et al.
8,712,857 B1 4/2014 Adornato et al.
D704,728 S 5/2014 d'Amore et al.
D707,249 S 6/2014 Yamada
D707,692 S 6/2014 d'Amore et al.
D707,700 S 6/2014 d'Amore et al.
D707,703 S 6/2014 d'Amore et al.
8,755,932 B2 6/2014 Peters et al.
8,777,103 B2 7/2014 Doglioni Majer
8,700,459 B2 8/2014 Lefkowitz
8,849,445 B2 9/2014 Holmes
D736,821 S 8/2015 d'Amore et al.
9,159,034 B2 10/2015 Pinckney et al.
9,171,316 B2 10/2015 Walker et al.
9,240,007 B2 1/2016 Barragan Trevino et al.
9,240,091 B2 1/2016 Segal et al.
9,245,230 B2 1/2016 Pinckney et al.
D749,111 S 2/2016 Trusz et al.
D756,460 S 5/2016 Bruck et al.
D757,088 S 5/2016 Moriya
9,334,112 B2 5/2016 Holmes
9,349,099 B2 5/2016 Pinckney et al.
D761,301 S 7/2016 Kim et al.
D762,709 S 8/2016 Hseih
2002/0054166 A1 5/2002 Decombe
2002/0145623 A1 10/2002 Decombe
2003/0197061 A1 10/2003 Din
2003/0225633 A1 12/2003 Sidio et al.
2004/0094386 A1 * 5/2004 Yuyama ..... G07F 11/42 198/347.1
2004/0213649 A1 * 10/2004 Robrechts ..... G07F 11/16 414/268
2005/0114786 A1 5/2005 Decombe
2006/0042193 A1 * 3/2006 Elustondo ..... G07F 9/026 53/442
2006/0229953 A1 10/2006 Walker et al.
2006/0261080 A1 11/2006 Matsumoto et al.
2007/0233317 A1 10/2007 Walker et al.
2007/0239519 A1 10/2007 Walker et al.

(56) References Cited

U.S. PATENT DOCUMENTS

| | | | | |
|---|---|---|---|---|
| 2008/0061076 | A1* | 3/2008 | Hieb | G07F 11/165 221/220 |
| 2008/0067189 | A1 | 3/2008 | Carter et al. | |
| 2009/0120761 | A1 | 5/2009 | Bashor et al. | |
| 2010/0228391 | A1 | 9/2010 | Hudis | |
| 2011/0017761 | A1 | 1/2011 | Roncari | |
| 2011/0054673 | A1* | 3/2011 | Segal | G07F 11/00 700/230 |
| 2011/0068116 | A1* | 3/2011 | Ardern | G07F 11/16 221/1 |
| 2012/0168344 | A1* | 7/2012 | Roncari | G07F 11/42 206/557 |
| 2012/0277904 | A1 | 11/2012 | Pritchard et al. | |
| 2012/0310771 | A1 | 12/2012 | Selinger et al. | |
| 2013/0246201 | A1 | 9/2013 | Sidio et al. | |
| 2013/0332239 | A1 | 12/2013 | Matre | |
| 2014/0001199 | A1 | 1/2014 | Bruck et al. | |
| 2014/0180790 | A1 | 6/2014 | Boal | |
| 2014/0180793 | A1 | 6/2014 | Boal | |
| 2014/0180802 | A1 | 6/2014 | Boal | |
| 2014/0180806 | A1 | 6/2014 | Boal | |
| 2014/0180808 | A1 | 6/2014 | Boal | |
| 2014/0180809 | A1 | 6/2014 | Boal | |
| 2014/0180810 | A1 | 6/2014 | Boal | |
| 2014/0180811 | A1 | 6/2014 | Boal | |
| 2014/0183211 | A1 | 7/2014 | Mockus et al. | |
| 2014/0222195 | A1 | 8/2014 | Bruck et al. | |
| 2014/0291346 | A1 | 10/2014 | Mockus et al. | |
| 2014/0297026 | A1 | 10/2014 | Peters, Jr. et al. | |
| 2014/0365001 | A1 | 12/2014 | Tomkins et al. | |
| 2015/0001241 | A1 | 1/2015 | Yeh et al. | |
| 2015/0082243 | A1 | 3/2015 | Taylor et al. | |
| 2015/0112789 | A1 | 4/2015 | Yadati et al. | |
| 2015/0127145 | A1* | 5/2015 | Kim | G06F 19/3462 700/235 |
| 2015/0142711 | A1 | 5/2015 | Pinckney et al. | |
| 2015/0379612 | A1 | 12/2015 | Selinger et al. | |
| 2016/0027231 | A1 | 1/2016 | Guzzone et al. | |
| 2016/0035000 | A1 | 2/2016 | Xu | |
| 2016/0078421 | A1 | 3/2016 | Barragan Trevino et al. | |
| 2016/0155285 | A9 | 6/2016 | Peters et al. | |

FOREIGN PATENT DOCUMENTS

| | | | |
|---|---|---|---|
| JP | 03121586 | A | 5/1991 |
| JP | 05012552 | A | 1/1993 |
| JP | 05020531 | A | 1/1993 |
| JP | 06076149 | A | 3/1994 |
| JP | 06131539 | A | 5/1994 |
| JP | 08147545 | A | 6/1996 |
| JP | 08329323 | A | 12/1996 |
| JP | 09282535 | A | 10/1997 |
| JP | 2002149827 | A | 5/2002 |
| WO | WO 9740476 | A1 | 10/1997 |

OTHER PUBLICATIONS

"StarNine Announces 'Bundle Up' Discount Program for Web Products" (Mar. 26, 1998), *Business Wire*, Berkeley, CA, 2 pages.

Merlat, W., "An agent-based multiservice negotiation for eCommerce" (Oct. 1999), BT Intelligent Business Systems Research, *BT Technology Journal*, vol. 17, No. 4, 8 pages.

Stanoevska-Slabeva, Katarina and Beat Schmid, "Cross-Supplier Bundling of Tourist Products with Multi-Vendor Electronic Catalogs" (2000), European Conference on Information Systems, ECIS 2000 Proceedings, 7 pages.

Yahalom, Raphael and Stuart E. Madniek, "e-Commerce Bargain-Hunting with an unBun Model", MIT-Sloan School of Management, Cambridge, MA, 11 pages.

* cited by examiner

MODULAR VENDING MACHINE

CROSS-REFERENCE TO RELATED APPLICATION

This application claims the benefit of U.S. Provisional App. No. 62/408,058, which is incorporated herein by reference in its entirety.

BACKGROUND

Field

Embodiments of the present invention relate to a modular vending machine for storing and dispensing products.

BRIEF SUMMARY OF THE INVENTION

One aspect of the invention permits a modular vending machine including a control module with a user interface, a payment system, vending controllers, and one or more vending cabinets that store products to be vended. Each cabinet can have a separate controller that can interact with the central controller. In another aspect, the modular vending machine can have a single controller located in the central control module. The controller can control all components in the vending cabinets.

In one aspect of the invention, a product dispenser can include a central module including a user interface and a product pickup area, a first product storage cabinet including a plurality of product shelves positioned within a first interior area, a second product storage cabinet including a plurality of product shelves positioned within a second interior area, a first product transport mechanism positioned within the first interior area to receive a first product from one of the plurality of product shelves in the first product storage cabinet and deliver the first product to the product pickup area, and a second product transport mechanism positioned within the second interior area to receive a second product from one of the plurality of product shelves in the second product storage cabinet and deliver the second product to the product pickup area, and including a first product orientation mechanism to orient the first product in the product pickup area in a vertically upright orientation. In an aspect the first product orientation mechanism can have a transfer position where a portion of the first product orientation mechanism spans a space between the product pickup area and the first product transport mechanism. The first product orientation mechanism can have a pickup position where the portion of the first product orientation mechanism extends into the product pickup area to orient the first product into a vertically upright orientation. The first product orientation mechanism can include a first pivot connecting the portion to the product pickup area, a second pivot connecting a control arm to the portion, and a third pivot connecting the control arm to a motorized slider.

In another aspect, the product dispenser can include a second product orientation mechanism to orient the second product in the product pickup area in a vertically upright orientation. The second product orientation mechanism can have a transfer position where a portion of the second product orientation mechanism spans a space between the product pickup area and the second product transport mechanism, and the second product orientation mechanism can have a pickup position where the portion of the second product orientation mechanism extends into the product pickup area to orient the second product.

In an aspect, the product dispenser can include a first product positioner to orient the first product onto the first product transport mechanism such that a bottom of the first product is positioned closer to the central module than a top portion of the first product. The product dispenser can include a second product positioner to orient the second product onto the second product transport mechanism such that a bottom of the second product is positioned closer to the central module than a top portion of the second product. The first product positioner can be attached to one of the plurality of product shelves in the first product storage cabinet, and the second product positioner can be attached to one of the plurality of product shelves in the second product storage cabinet. The first product positioner and the second product positioner can be non-motorized.

In a further aspect, the product dispenser can include a third product storage cabinet including a plurality of product shelves positioned within a third interior area, and a third product transport mechanism positioned within the third interior area to receive a third product from one of the plurality of product shelves in the third product storage cabinet and deliver the third product to the product pickup area. The third product can travel through the second product storage cabinet via the second product transport mechanism to deliver the third product to the product pickup area. In another aspect, the third product storage cabinet can include a product pickup area. The third product can be delivered to the product pickup area in the third product storage cabinet rather than the product pickup area in the central module.

In another aspect, a product dispenser can include a central module including a user interface and a product pickup area, a first product storage cabinet including a plurality of product shelves positioned within a first interior area, a first product transport mechanism positioned within the first interior area to receive a first product from one of the plurality of product shelves in the first product storage cabinet and deliver the first product to the product pickup area, and a first product orientation mechanism to orient the first product in the product pickup area in a vertically upright orientation. The first product orientation mechanism can have a transfer position where a portion of the first product orientation mechanism spans a space between the product pickup area and the first product transport mechanism. The first product orientation mechanism can have a pickup position where the portion of the first product orientation mechanism extends into the product pickup area to orient the first product into a vertically upright orientation. The first product orientation mechanism can include a first pivot connecting the portion to the product pickup area, a second pivot connecting a control arm to the portion, and a third pivot connecting the control arm to a motorized slider.

In another aspect, a method for dispensing a product can include transmitting a first electronic signal to a control system based on a first user selection on an electronic user interface, moving a first product transport mechanism into a first vertical position to receive a first product from a first storage shelf based on the first electronic signal, moving the first product transport mechanism into a first vertical delivery position to deliver the first product into a pickup area, moving a first product orientation mechanism into a transfer position to receive the first product from the first product transport mechanism, and moving the first product into the pickup area. The method can include transmitting a second electronic signal to the control system based on a second user selection on the electronic user interface, moving a second product transport mechanism into a second vertical position to receive a second product from a second storage shelf based on the second electronic signal, moving the second product transport mechanism into a second vertical delivery position to deliver the second product into the pickup area, moving a second product orientation mechanism into a transfer position to receive the second product from the second product transport mechanism, and moving the second product into the pickup area. The method can include moving the first product orientation mechanism into a pickup position to orient the first product in a vertically upright orientation in the pickup area, and moving the second product orientation mechanism into a pickup position to orient the second product in a vertically upright orientation in the pickup area.

Further features and advantages of embodiments of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to a person skilled in the relevant art(s) based on the teachings contained herein.

BRIEF DESCRIPTION OF THE DRAWINGS/FIGURES

The accompanying drawings, which are incorporated herein and form part of the specification, illustrate embodiments of the present invention and, together with the description, further serve to explain the principles of the invention and to enable a person skilled in the relevant art(s) to make and use the invention.

Figure 5:
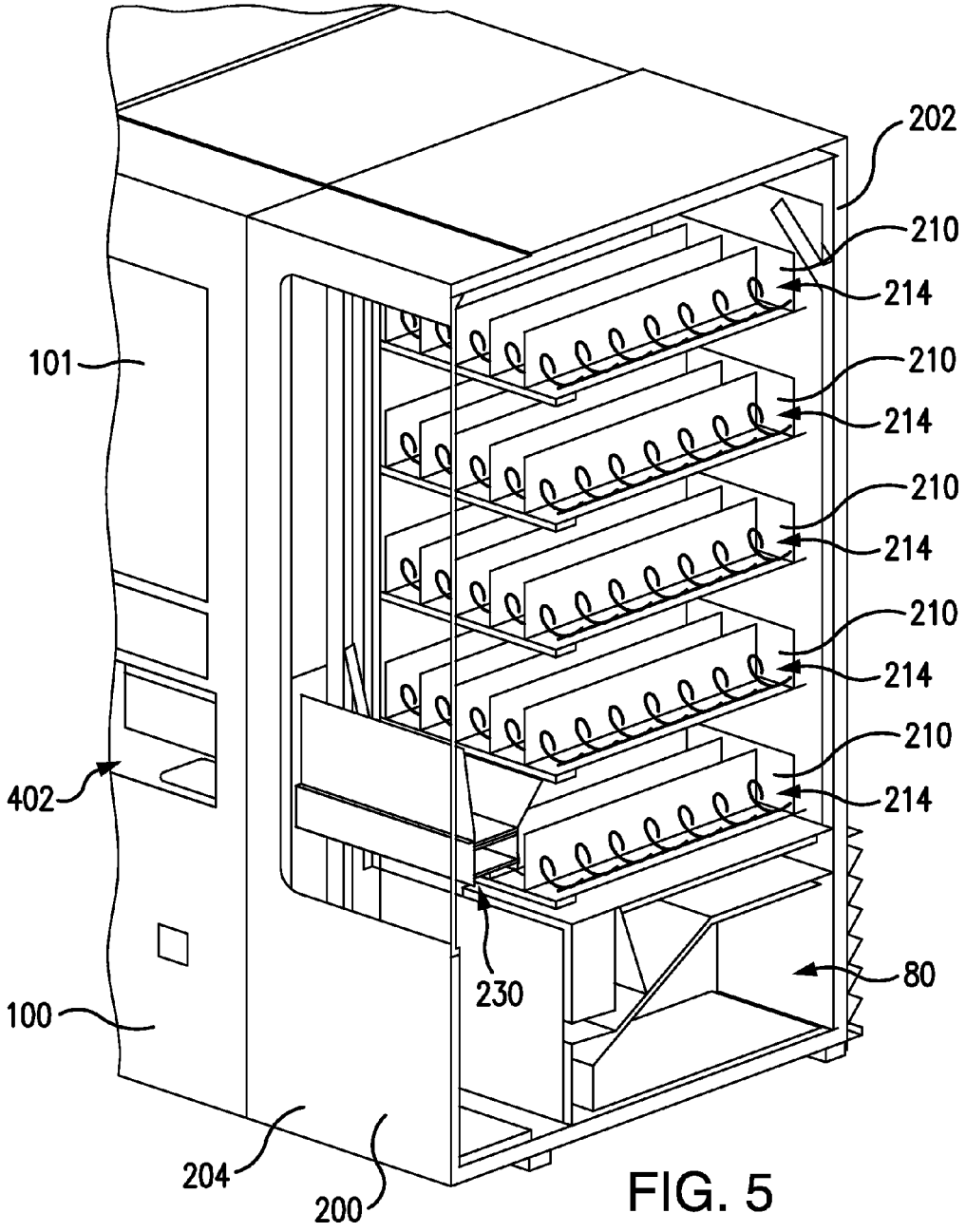

FIG. 5. is partial perspective view of a control module and a vending cabinet according to various aspects of the invention.

Figure 6:
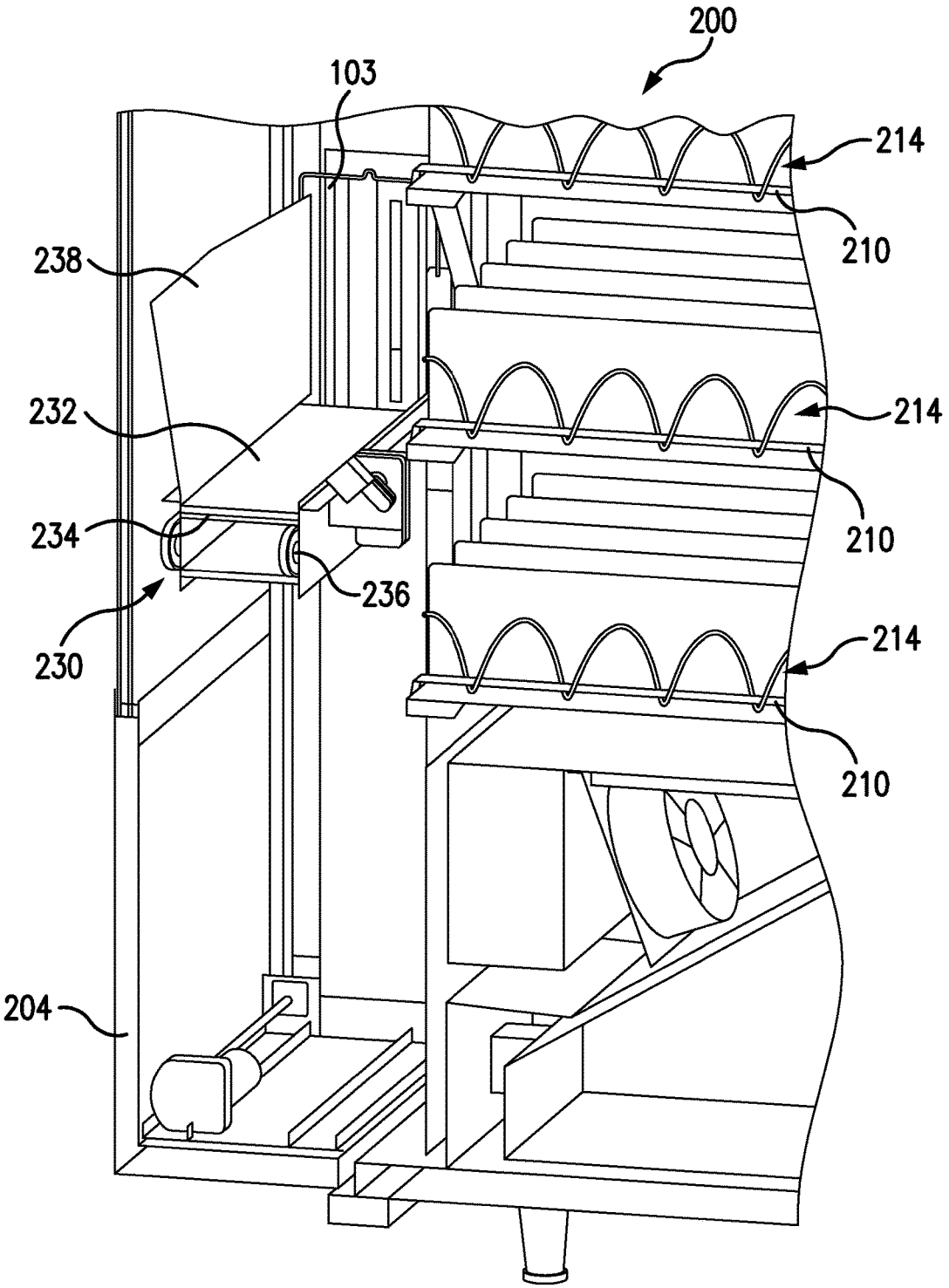

FIG. 6. is a partial perspective view of a vending cabinet and product transport mechanism according to various aspects of the invention.

Figure 7:
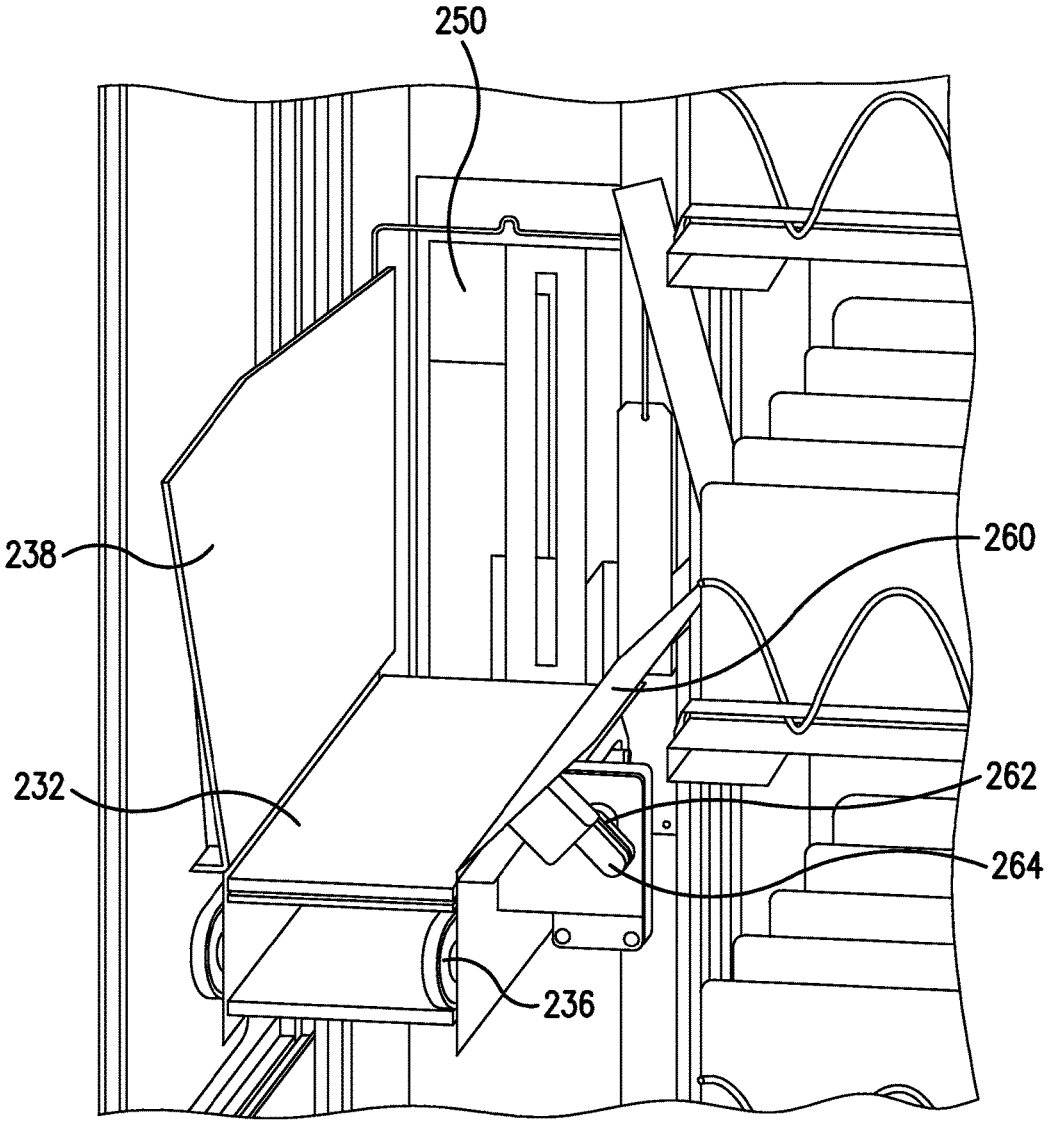

FIG. 7. is a partial perspective view of a vending cabinet and product transport mechanism according to various aspects of the invention.

Figure 8:
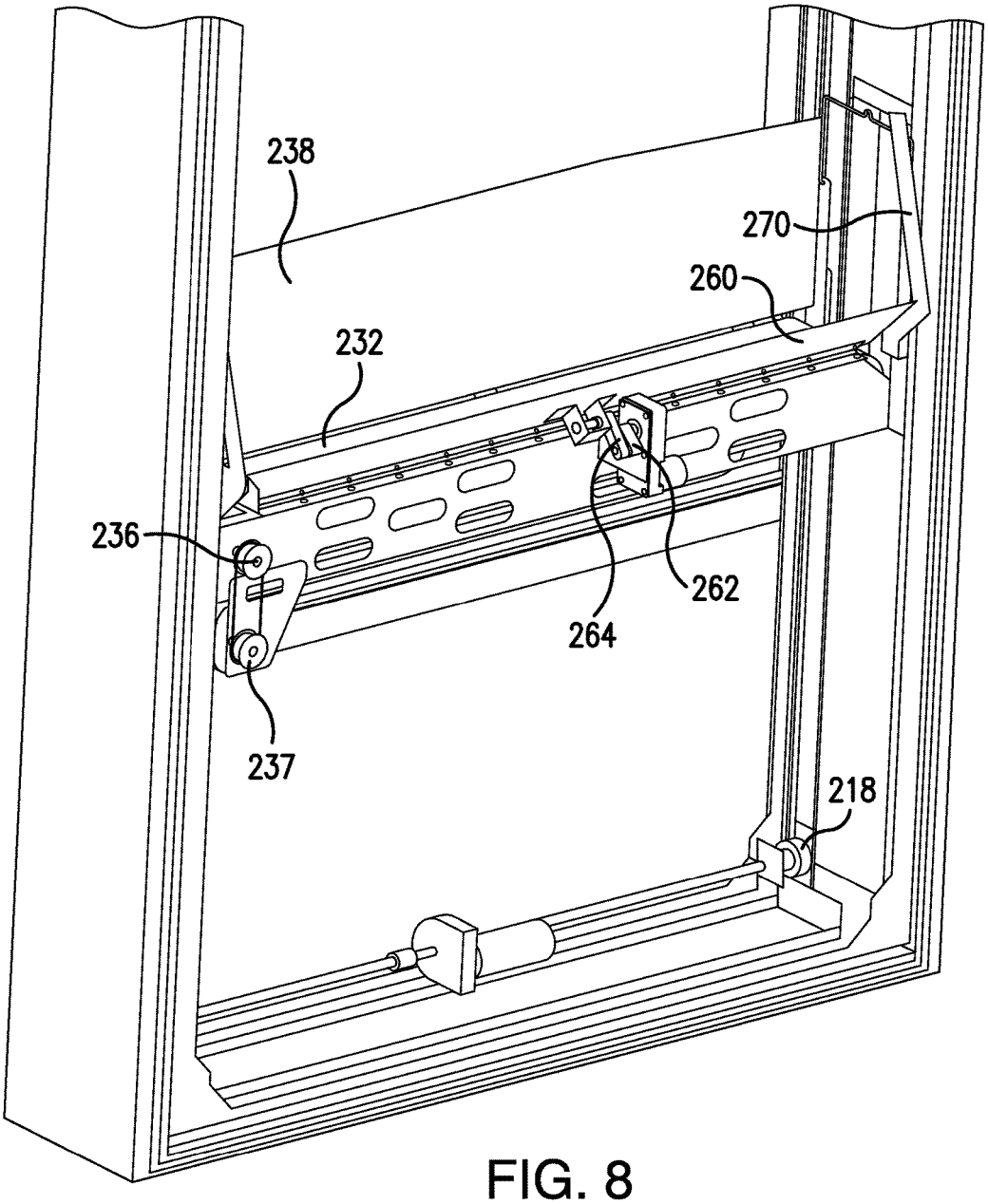

FIG. 8 is a perspective view of a product transport mechanism according to various aspects of the invention.

Figure 9:
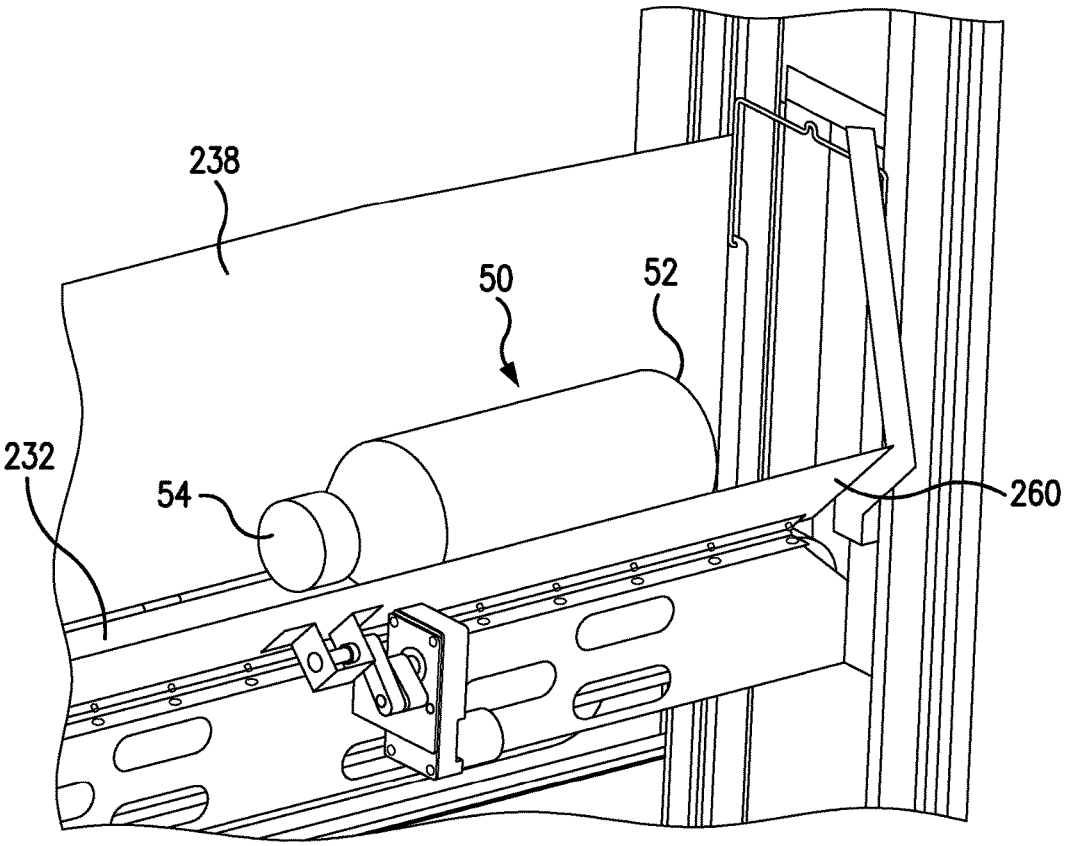

FIG. 9 is a close up perspective view of a product transport mechanism according to various aspects of the invention.

Figure 10:
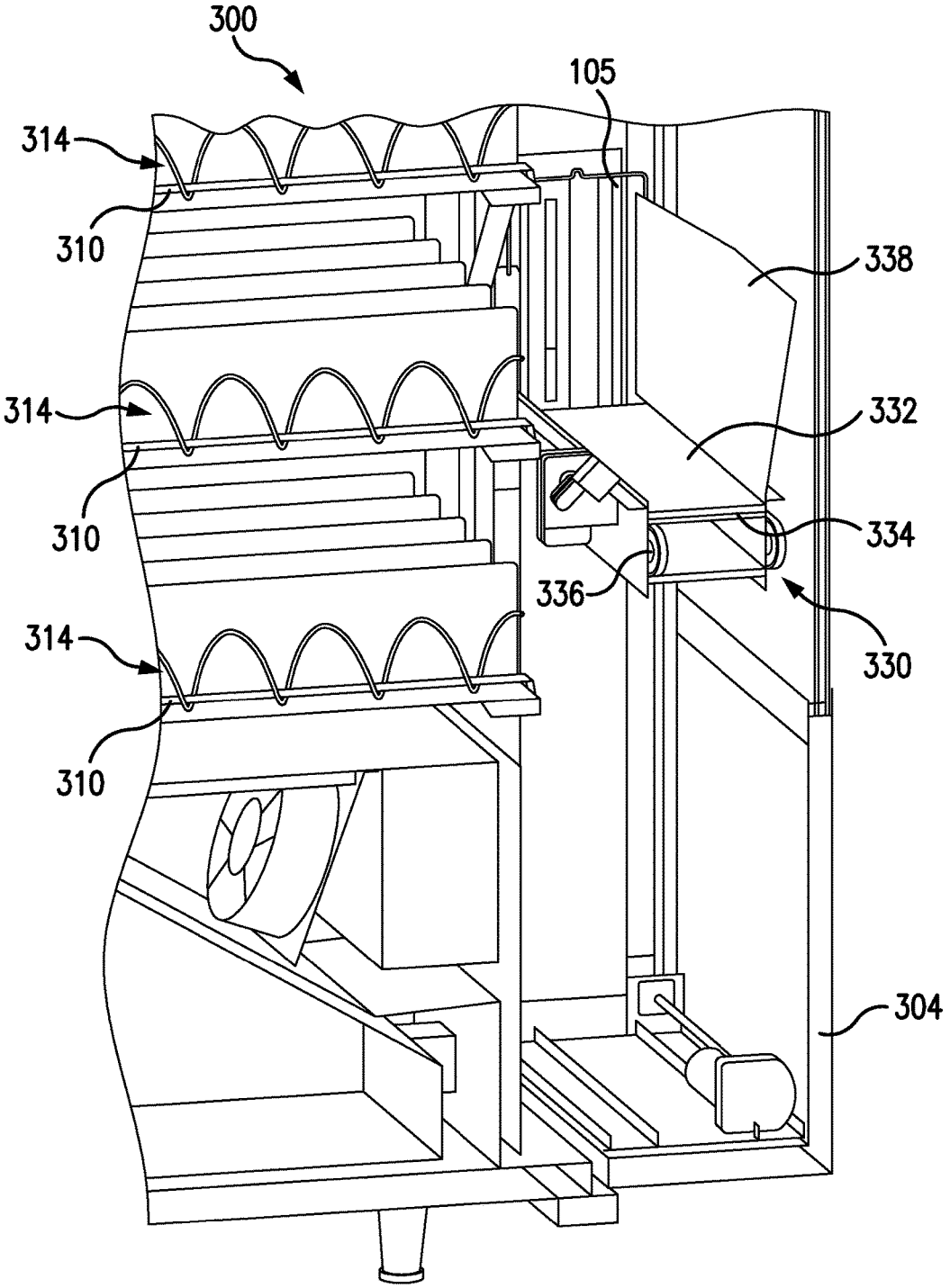

FIG. 10. is a partial perspective view of a vending cabinet and product transport mechanism according to various aspects of the invention.

Figure 11:
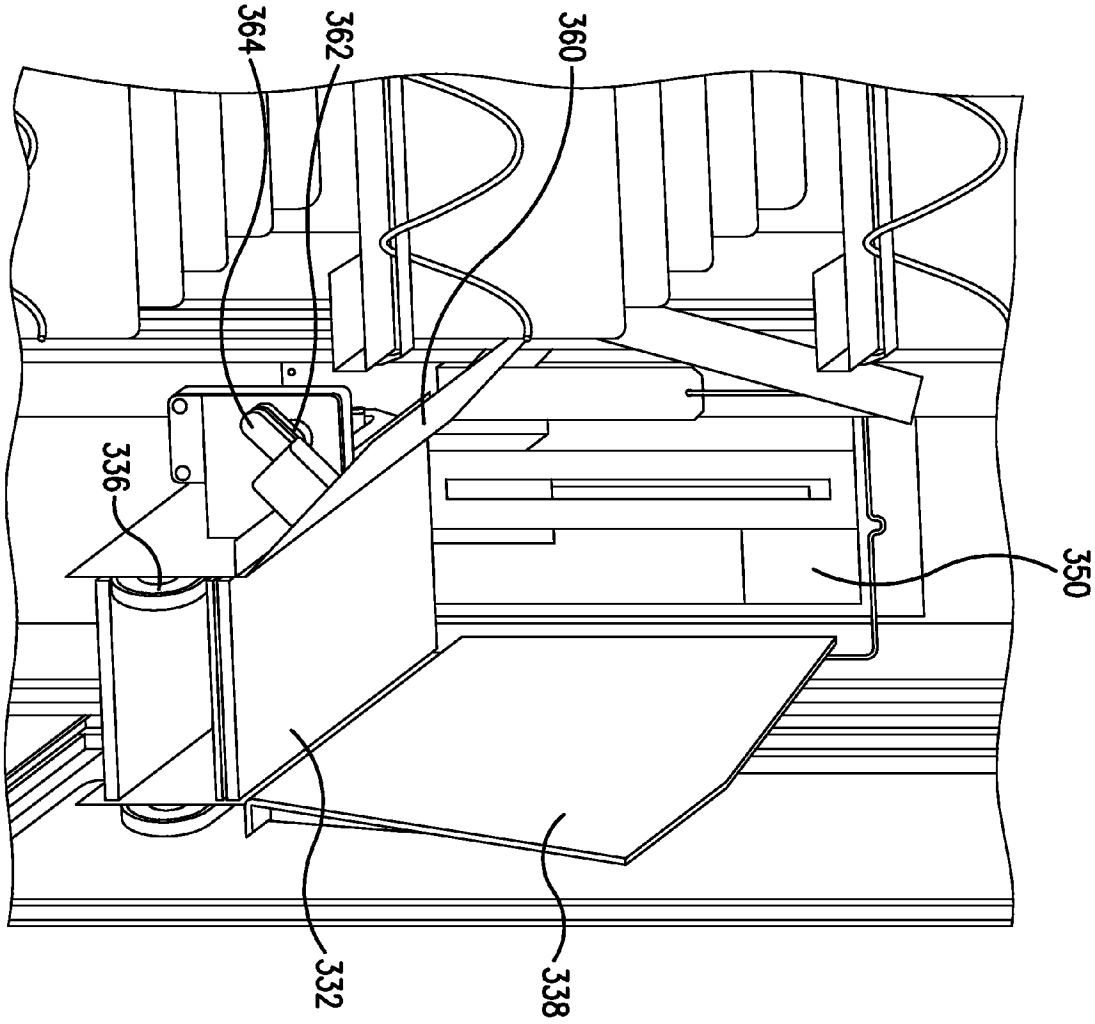

FIG. 11. is a partial perspective view of a vending cabinet and product transport mechanism according to various aspects of the invention.

Figure 12:
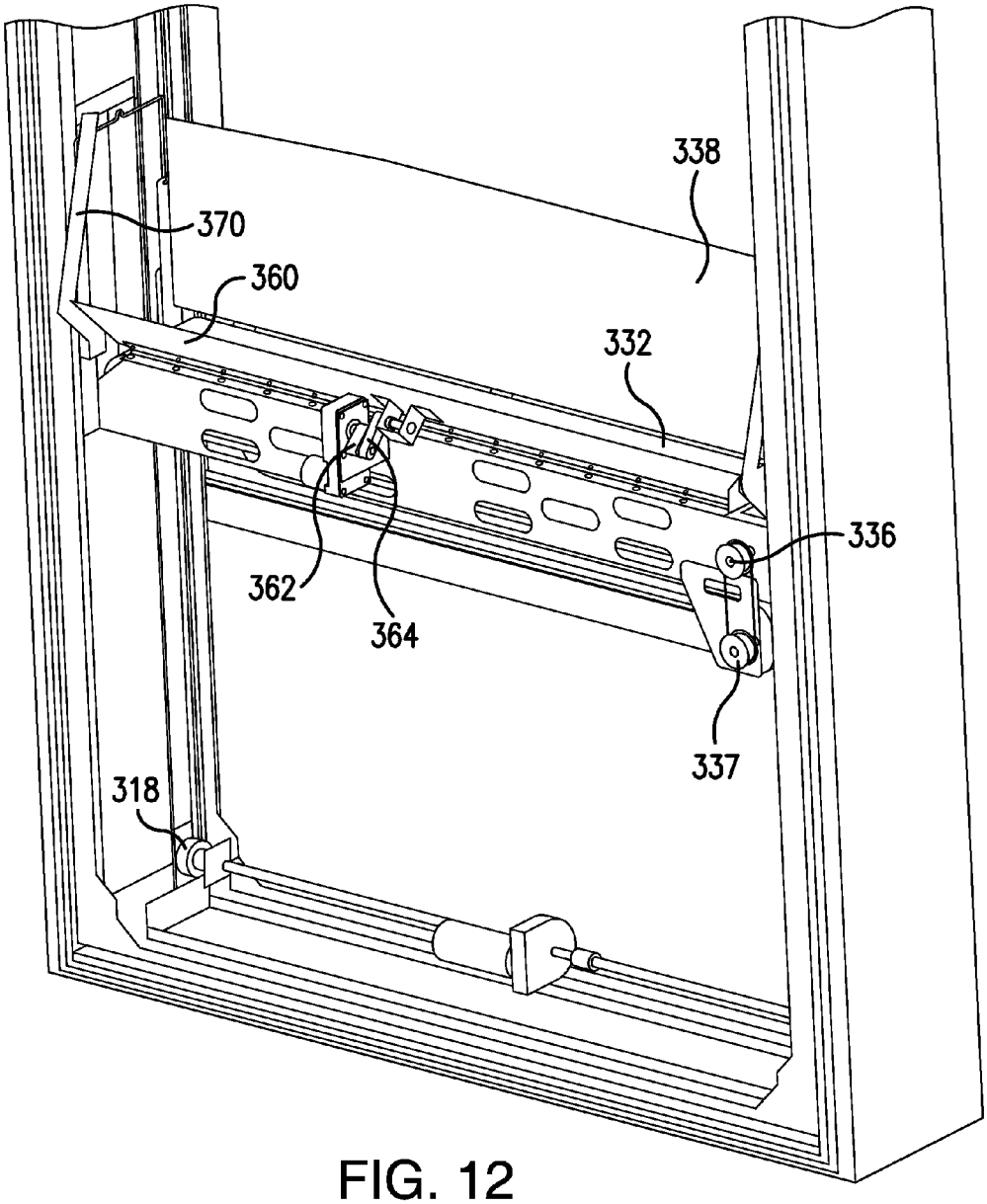

FIG. 12 is a perspective view of a product transport mechanism according to various aspects of the invention.

Figure 13:
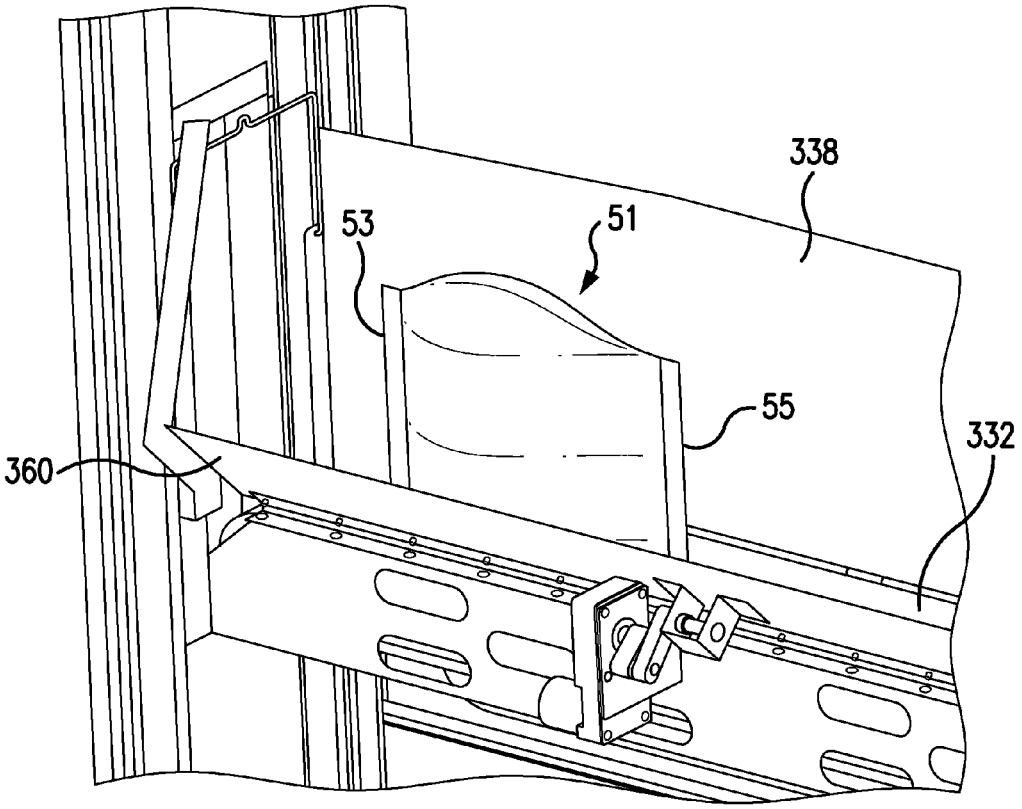

FIG. 13 is a close up perspective view of a product transport mechanism according to various aspects of the invention.

Figure 14:
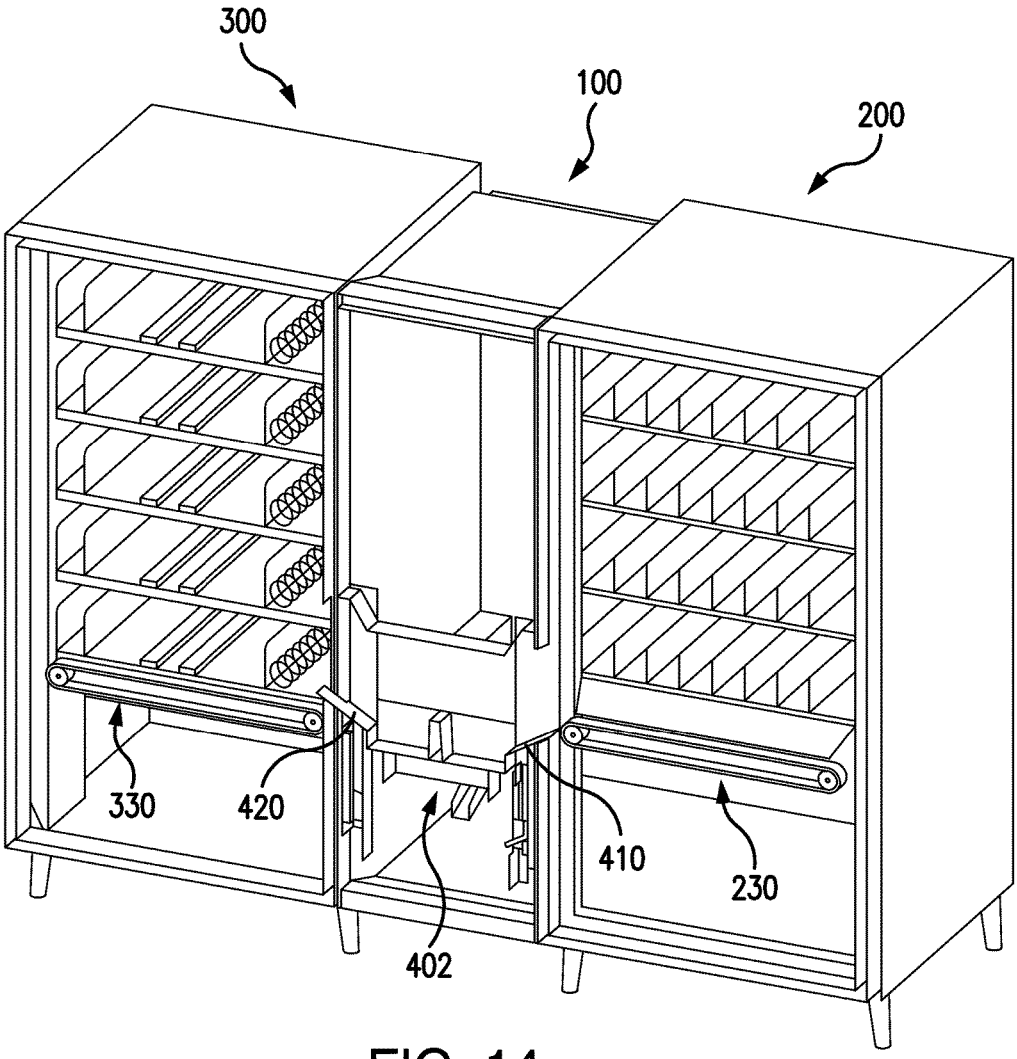

FIG. 14 is a perspective view of a modular vending system according to various aspects of the invention.

Figure 15:
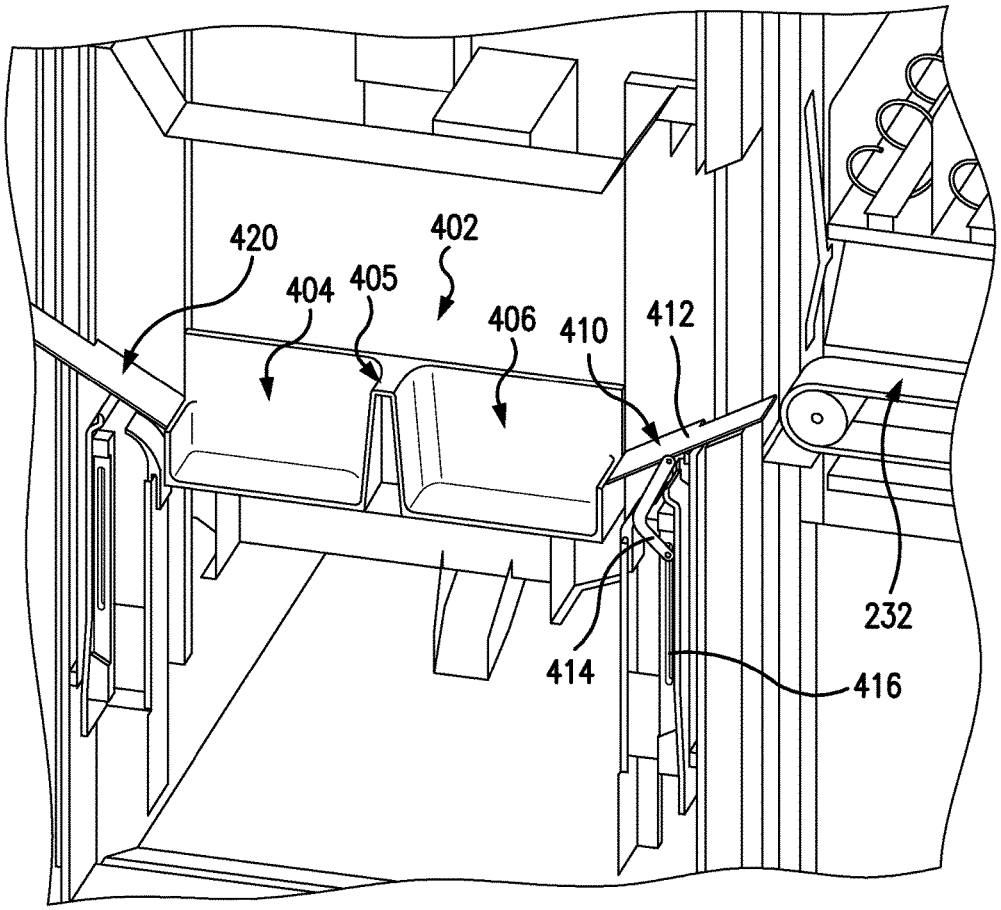

FIG. 15 is a perspective view of a pickup area according to various aspects of the invention.

Figure 16:
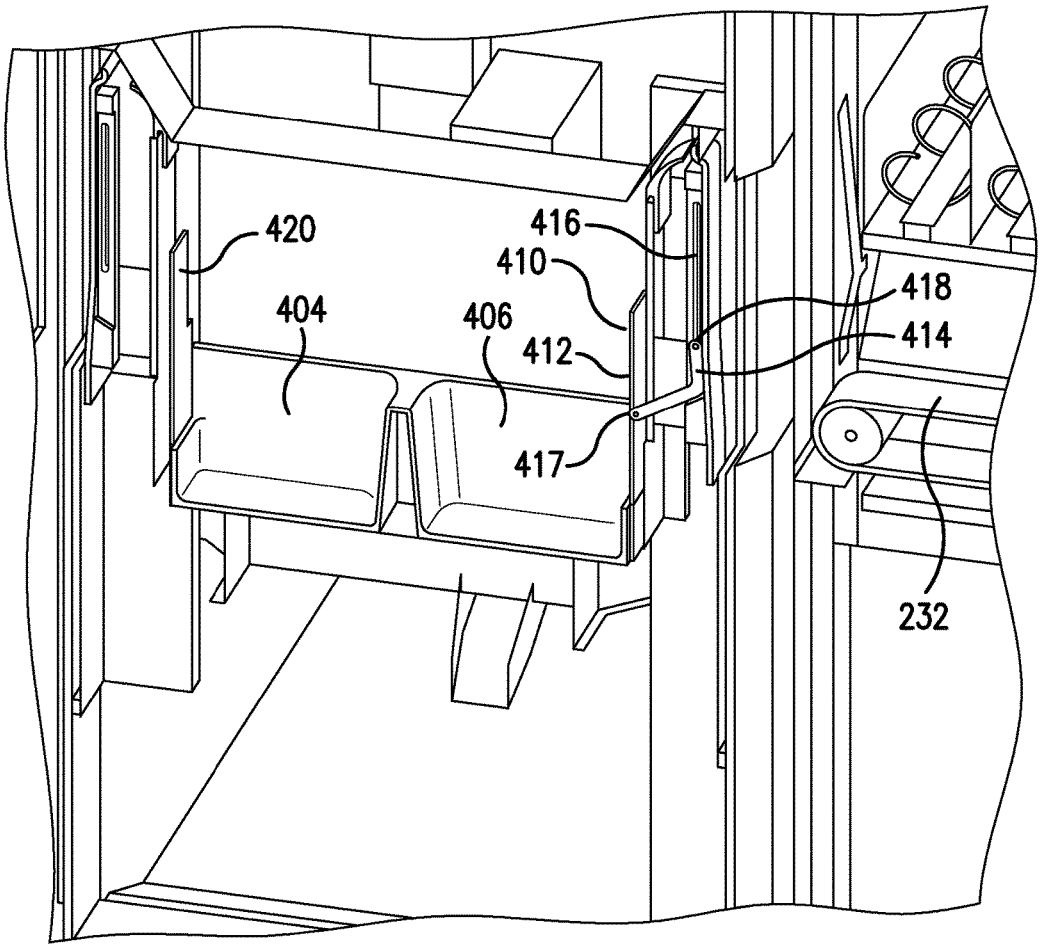

FIG. 16 is a perspective view of a pickup area according to various aspects of the invention.

Figure 17:
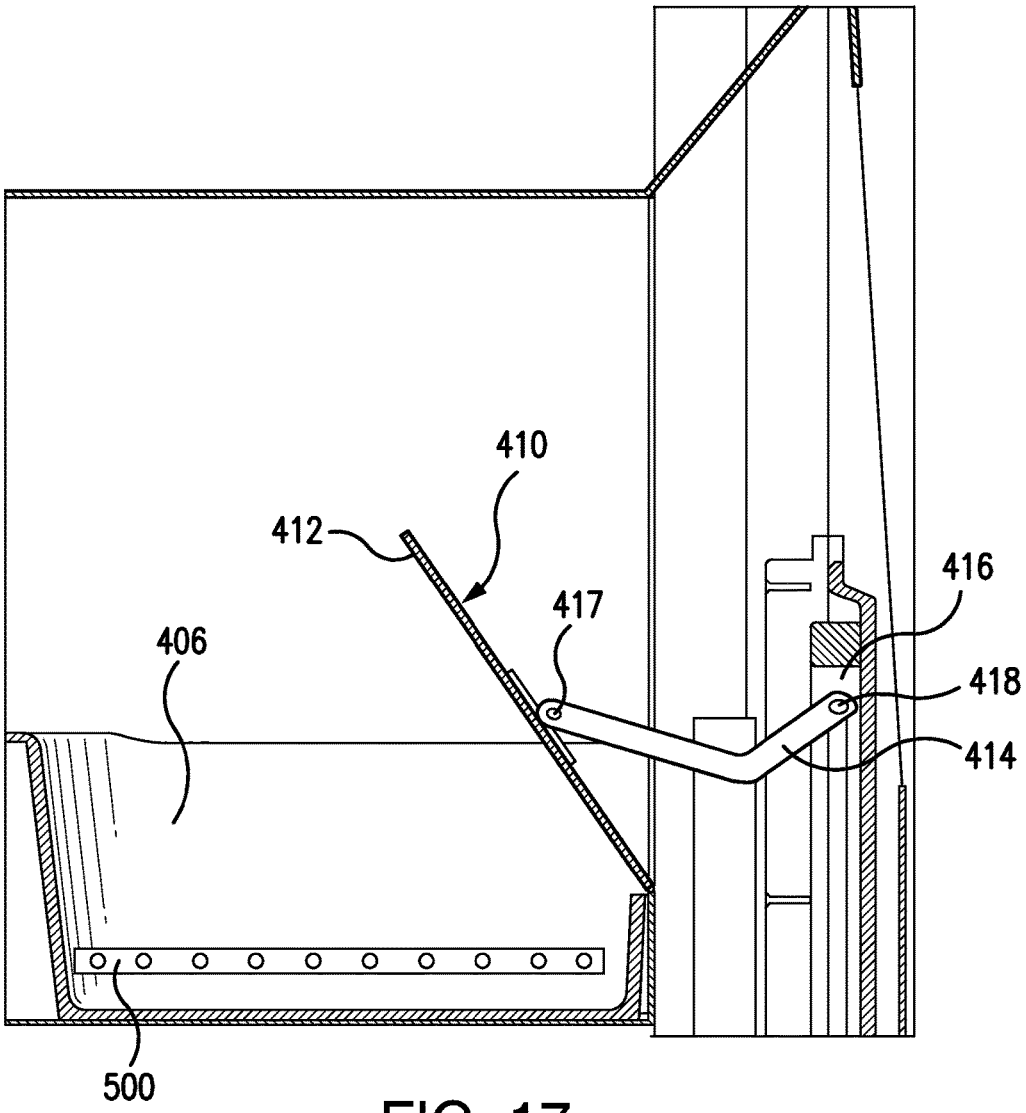

FIG. 17 is a front view of a pickup area and product orientation mechanism according to various aspects of the invention.

Figure 18:
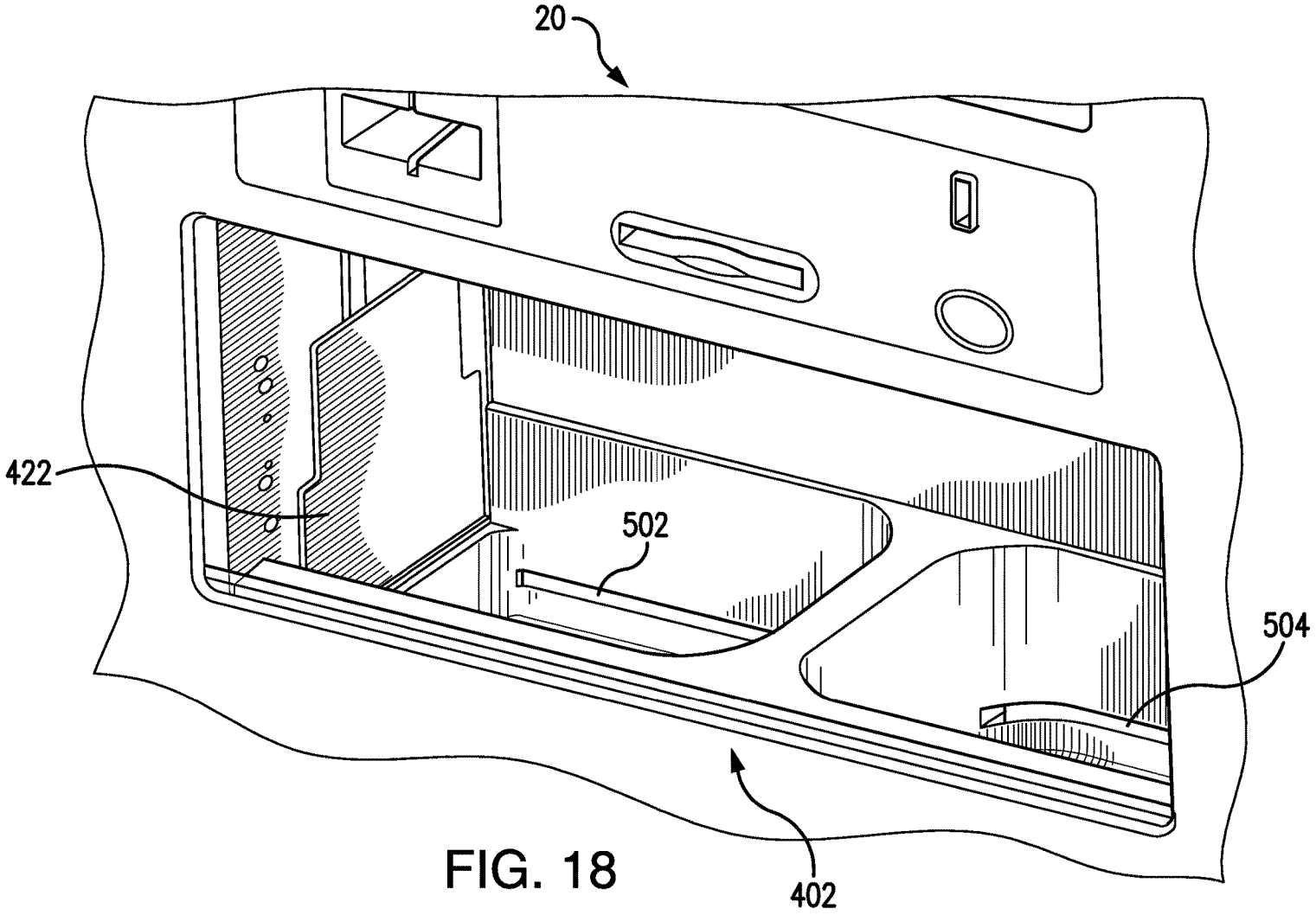

FIG. 18 is a perspective view of a pickup area according to various aspects of the invention.

Figure 19:
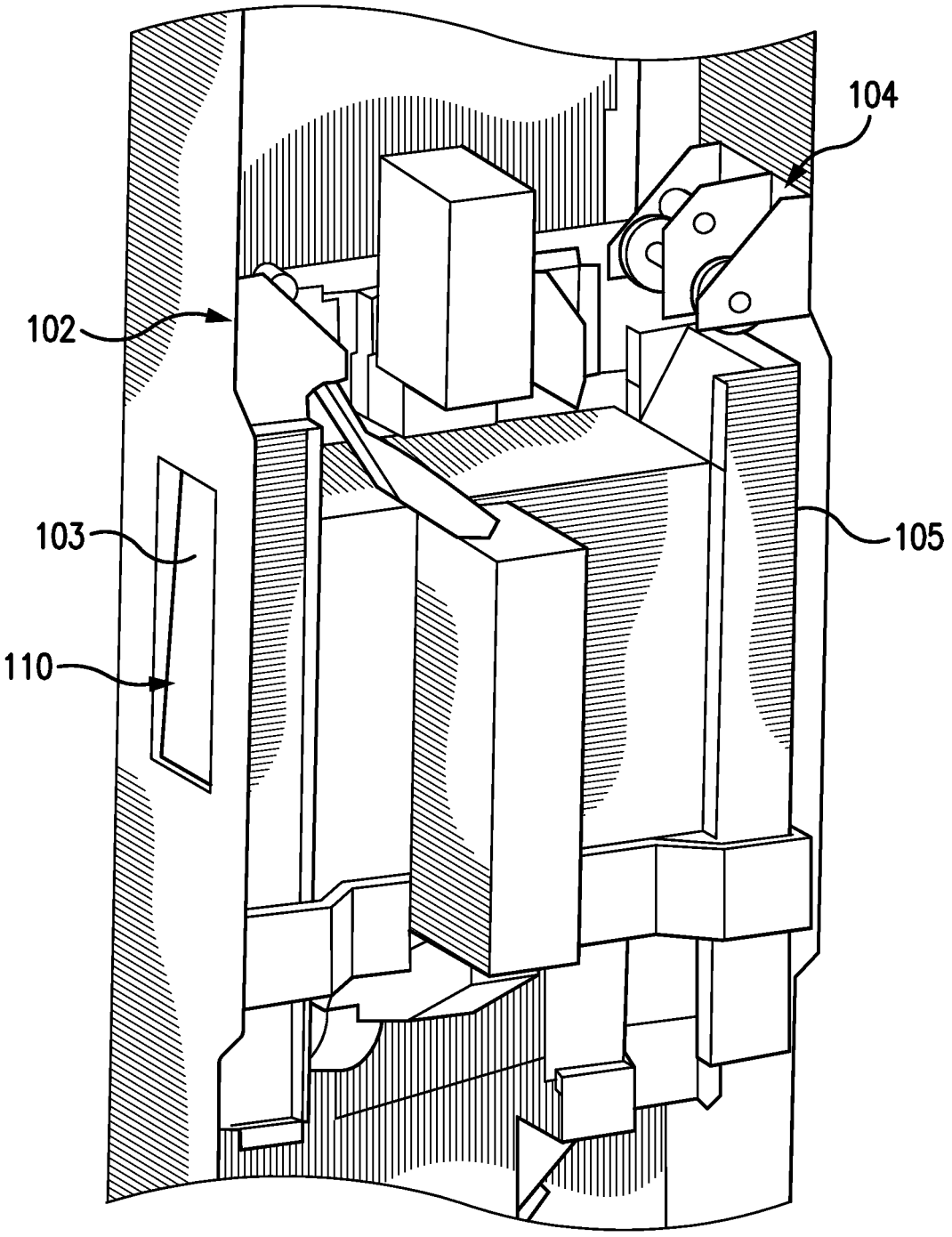
Figure 20:
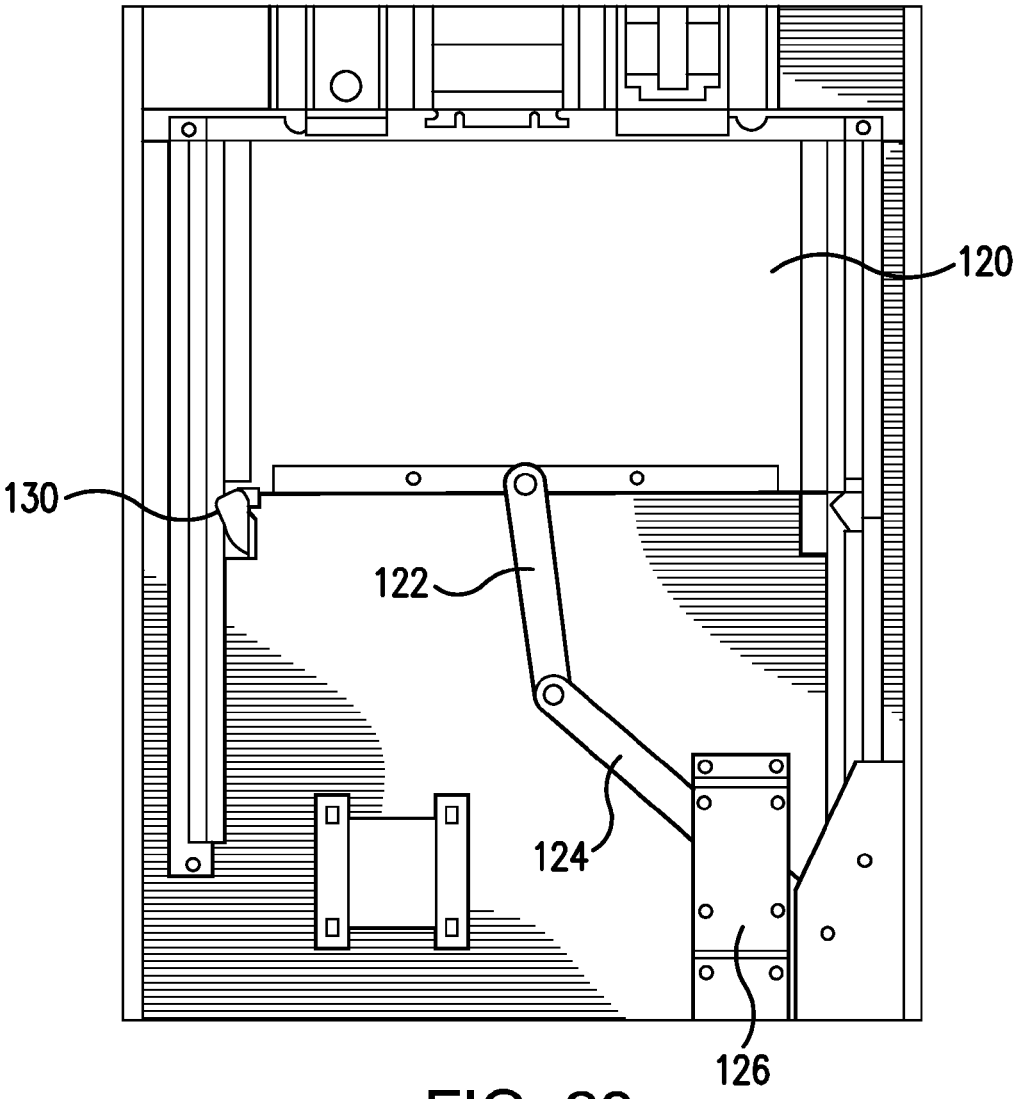

FIG. 19 is a perspective view of a rear portion of a control module according to various aspects of the invention FIG. 20 is a rear view of a pickup area door according to various aspects of the invention.

Figure 21:
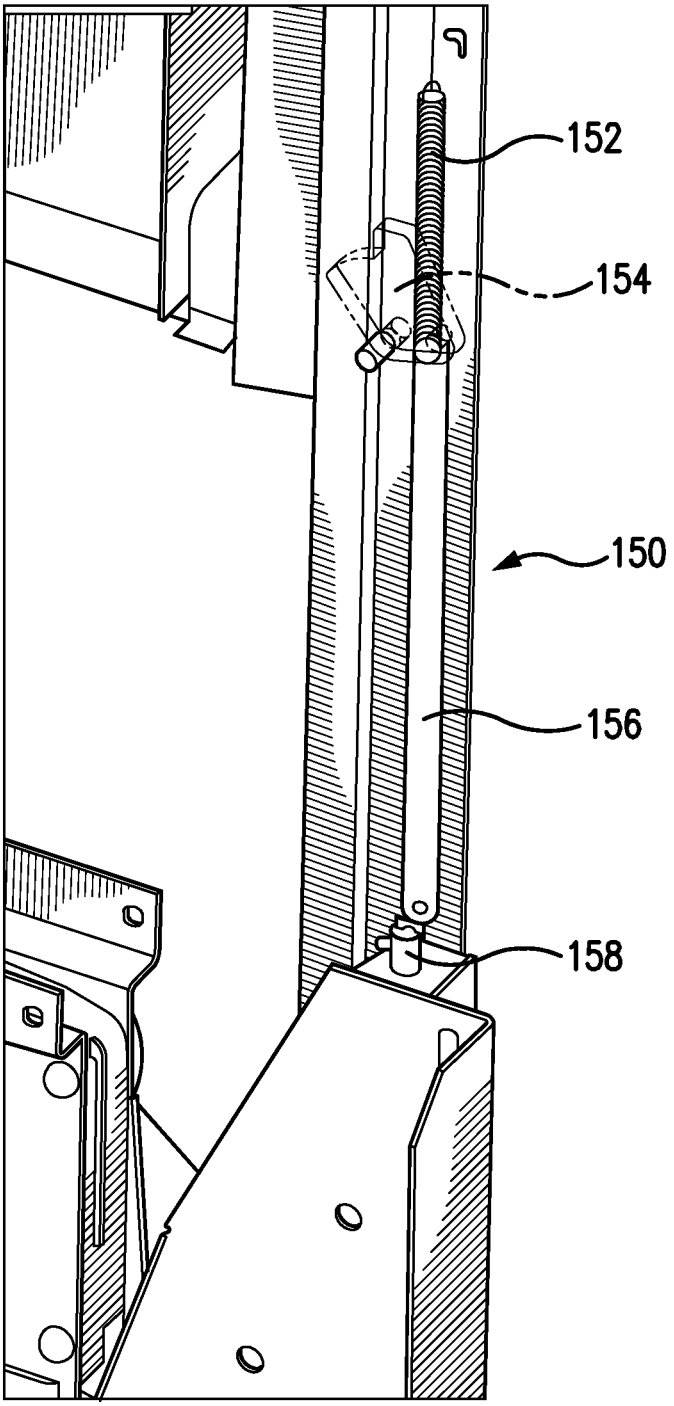

FIG. 21 is a perspective view of a pickup area door mechanism according to various aspects of the invention.

Figure 22:
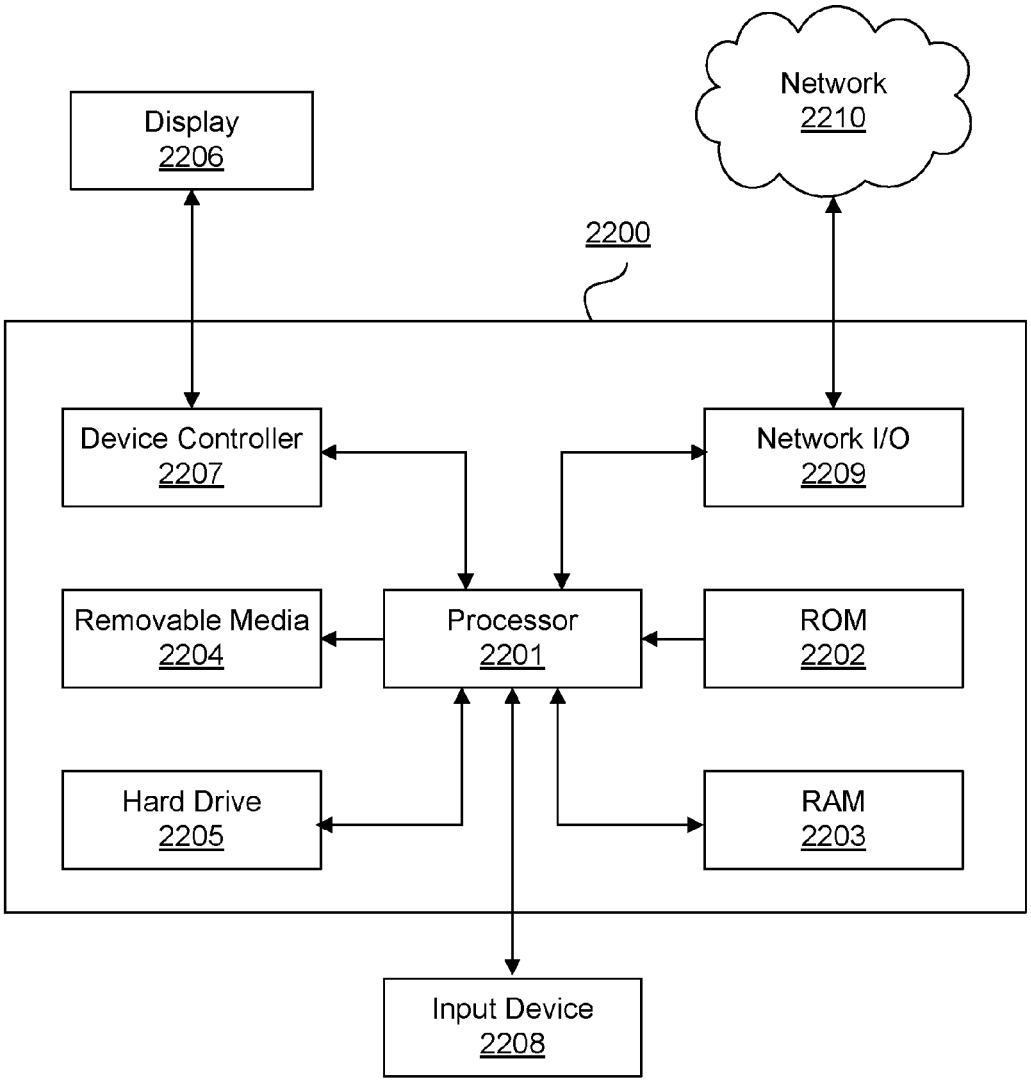

FIG. 22 illustrates an example hardware platform according to various aspects of the invention.

Figure 23:
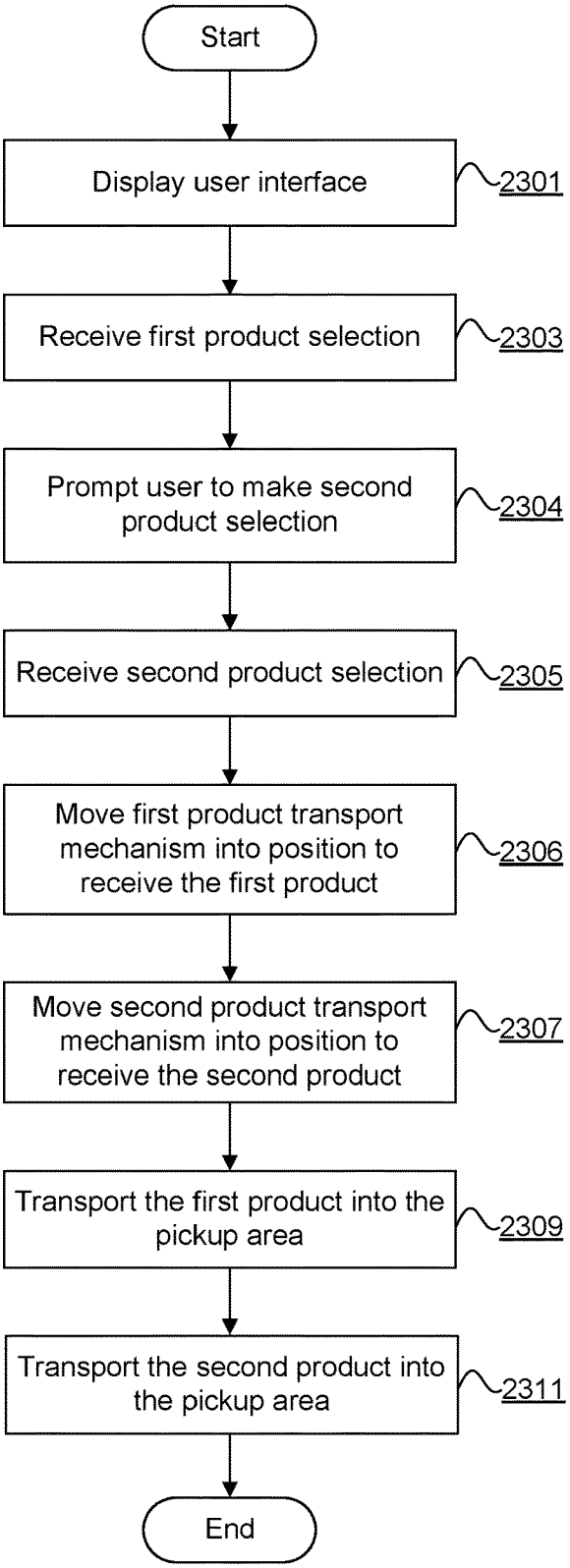

FIG. 23 is a block diagram of an example method for dispensing products according to various aspects of the invention.

Figure 24:
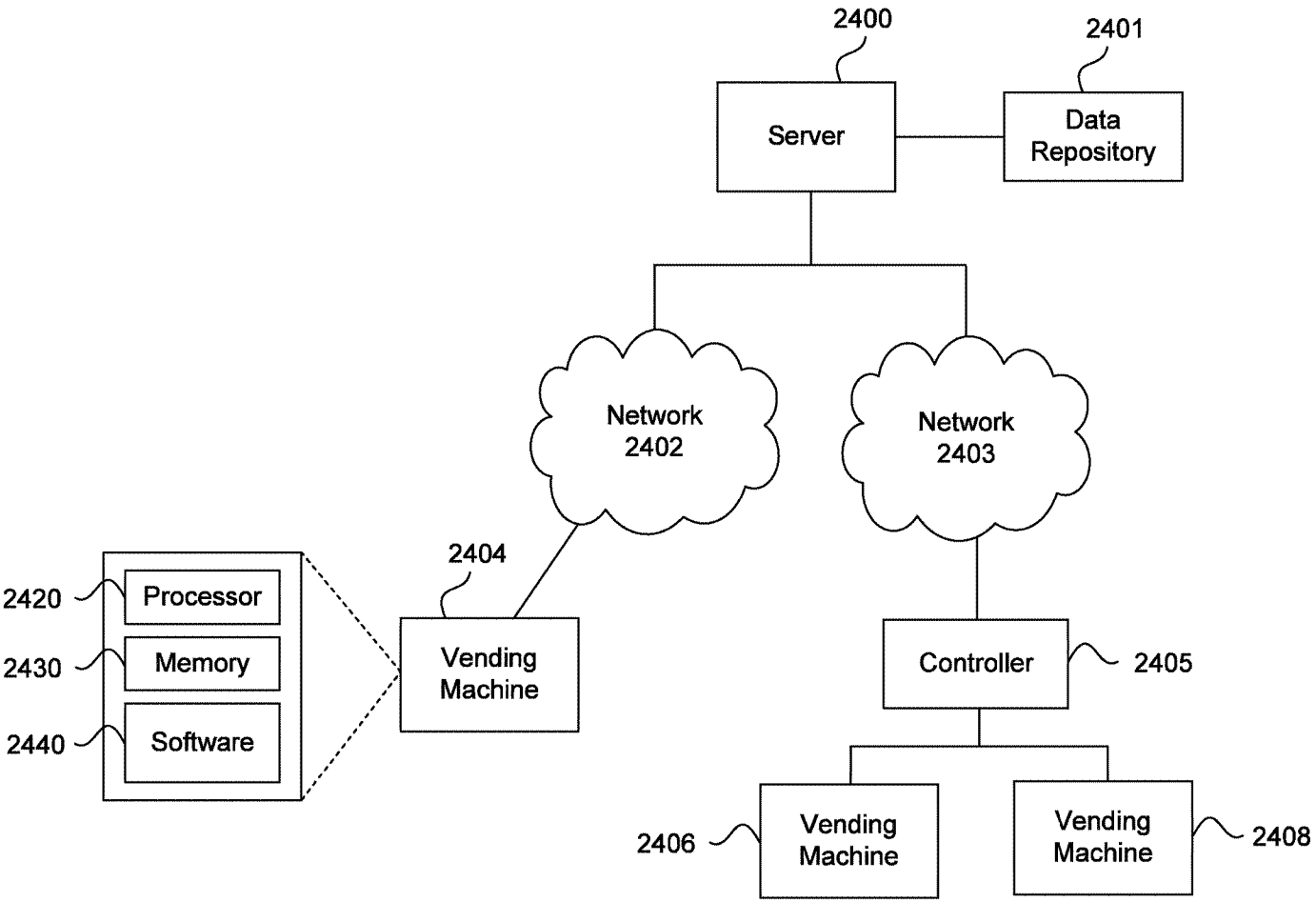

FIG. 24 is a block diagram of an example communication network according to various aspects of the invention.

Features and advantages of the embodiments will become more apparent from the detailed description set forth below when taken in conjunction with the drawings, in which like reference characters identify corresponding elements throughout.

DETAILED DESCRIPTION OF THE INVENTION

The present invention(s) will now be described in detail with reference to embodiments thereof as illustrated in the accompanying drawings. References to "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Vending machines are used to store and deliver products (e.g., beverages and/or food in bottles, cans, boxes, etc.) to consumers. Conventional vending machines often deliver the products by dropping the products into a pick-up space where the consumer opens a hinged door, for example, to retrieve the product. Presenting the product to the consumer in a vertically upright orientation, rather than dropping the product, would improve the quality of the product and result in a better user experience.

Accordingly, in some embodiments a modular vending machine can include a control module that can include a user interface, a payment system, vending controllers, and one or more vending cabinets that store products to be vended. Each cabinet can have a separate controller that can interact with the central controller. Each of the vending cabinet, and the central control module can be manufactured, packaged, shipped separately from factory, and then connected and installed together at the destination field location. In another aspect, a single controller can be centrally located in center control module 100.

In some embodiments, the control module can include a pickup area where the product from each cabinet can be delivered to, and the area is accessible by consumer to pick up all products purchased. The vending cabinets do not require a dedicated area for product to be picked up by consumer. With this solution, multiple products from different cabinets can be selected by a consumer and vended, though the central user interface, which provides the options of beverage, food, etc., or combinations of different products. This solution makes it easier for a consumer to pick up a product, because all products are delivered to one area. In addition, this product pick-up area is located at a level higher than the current vending machines, which make it easier for consumer to pick up the product without bending.

In some embodiments, the storage system is modular. In some embodiments, the storage system comprises one or more shelves. In some embodiments, the plurality of shelves forms a grid of product storage areas. In some embodiments, each shelf is configured to dispense vending products. For example, each shelf may be angled downward so that gravity pulls vending products out of the shelf. As another example, each shelf may include a mechanism to dispense vending products, such as a spring-loaded product pusher. In some embodiments, each shelf comprises a gate that keeps the vending products on the shelf until the vending machine is ready to dispense the vending product. In some embodiments, a spiral or corkscrew shaped motorized wire that can rotate one full turn in order to dispense a single item from the vending machine in response to a user input.

In some embodiments, each vending cabinet can include a product transport system that delivers the product to a pickup area in the control module. The product transport system interacts with the vending system and other components to dispense, transport, and present vending products to consumers in a vertically upright orientation. In some embodiments, the interactions are primarily mechanical, thus reducing the complexity of the vending machine and reducing the need for service and maintenance. The product transport system can include an elevation system driven by motor. The motor can be controlled by a controller in the vending cabinet. The elevation system can be moved up and down vertically to catch a product vended from the product storage shelves. The elevation system can include a transfer belt driven by another motor.

In some embodiments, the side walls of the central control module, and the side wall of the vending cabinets can include openings through which the product packages can pass through. The storage shelves in each vending cabinets are also controlled by motors to push the products selected from the shelf to the elevation system.

In some embodiments, a consumer can select multiple products through a user interface. The controller in the control module can send instruction to the controls in the vending cabinets. The controllers in the vending cabinets can then send signal to motors of the shelf based on the selection, to push the product out of the shelf. The elevation system can be driven by the motor which receives signals from the controller to move to the shelf, based on the product selection, to catch the product package from the shelf. After the package travels onto the elevator, the belt can start moving, driven by its dedicated motor which received signal from the controller. The package on the belt can then be transferred by the belt to the opening on the side wall. The gate that normally covers the opening will be opened, controlled by motor, to allow the package to go through. At the same time, a product orientation mechanism in the control model around the pick-up area can tilt downward to ensure a smooth movement of the package from the vending cabinet to the pick-up area. Once the product travels into a pick-up area pocket a vertical position lower than the elevation system belt, the package orientation mechanism can rotate back to vertical and further into the pick-up area to orient the product into a vertically upright position. In some embodiments, the controller in the center control module can directly control the mechanisms in the vending cabinets.

In some embodiments, a product positioner can be attached onto the shelves, for example, on one side wall of the gate. As the product travels to the belt in the orientation that the bottom of the package is pointing to the product pick-up area of the central module, and the top of the package is pointing away from the central module. This way, the package can be transferred to the central module and can travel into the product pickup area with its bottom first entering the pocket, so it can stand up vertically with the help of the package orientation mechanism in the central module mentioned above.

In some embodiments, sensors (optical, mechanical, etc.) can be utilized in the machine on different mechanisms to ensure the accurate timing and control of the movement of each moving components, to ensure the proper functions.

In some embodiments, multiple vending cabinets can share the same product pick-up area. Alternatively, one or more specific cabinets can include a dedicated product pick-up area on the cabinet in a say similar to the current vending machines. The configuration of multiple vending cabinets including, for example, a refrigerated cabinet and non-refrigerated cabinet, can make it possible to have larger storage capacity, more different types of products (for instance, different temperature requirements, etc.), in an cost efficient way by having one control module, and have different temperature setting in different cabinets with dedicated cooling or heating instruments.

In some embodiments, the product pickup area comprises a pickup area door that isolates the pickup area from outside the vending machine.

The vending products may include drinks, such as bottled water, energy drinks, carbonated soft drinks, milks, juices, sports drinks, etc., as well as food, such as chips, granola bars, energy bars, sandwiches, ice cream bars, candy, and other snacks. The vending products may be packaged in different sizes, shapes, and styles. While consumables are primarily discussed herein, the principles disclosed apply to other types of vending products as well. The vending machines disclosed herein may be used in any setting (e.g., school campuses, stores, malls, offices, etc.).

These and other embodiments are discussed below with reference to the figures. However, those skilled in the art will readily appreciate that the detailed description given herein with respect to these figures is for explanatory purposes only and should not be construed as limiting.

Figure 1:
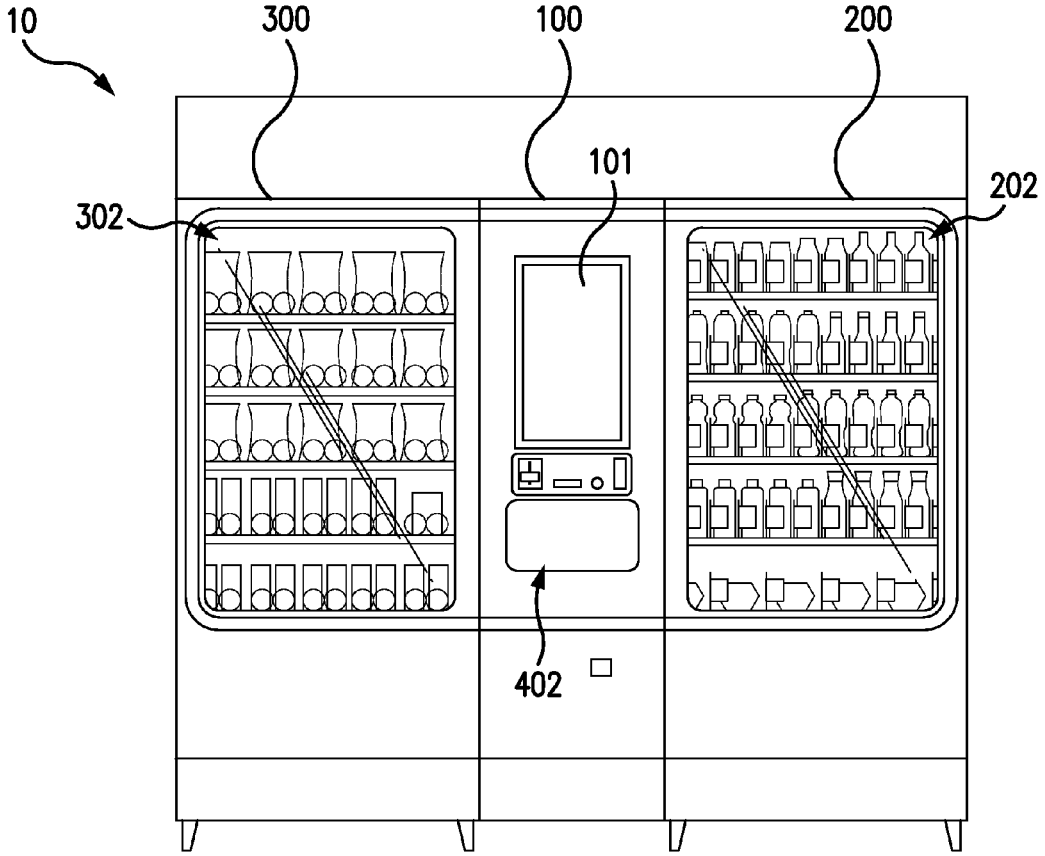
FIG. 1 is a front view of a modular vending machine according to various aspects of the invention.
Figure 2:
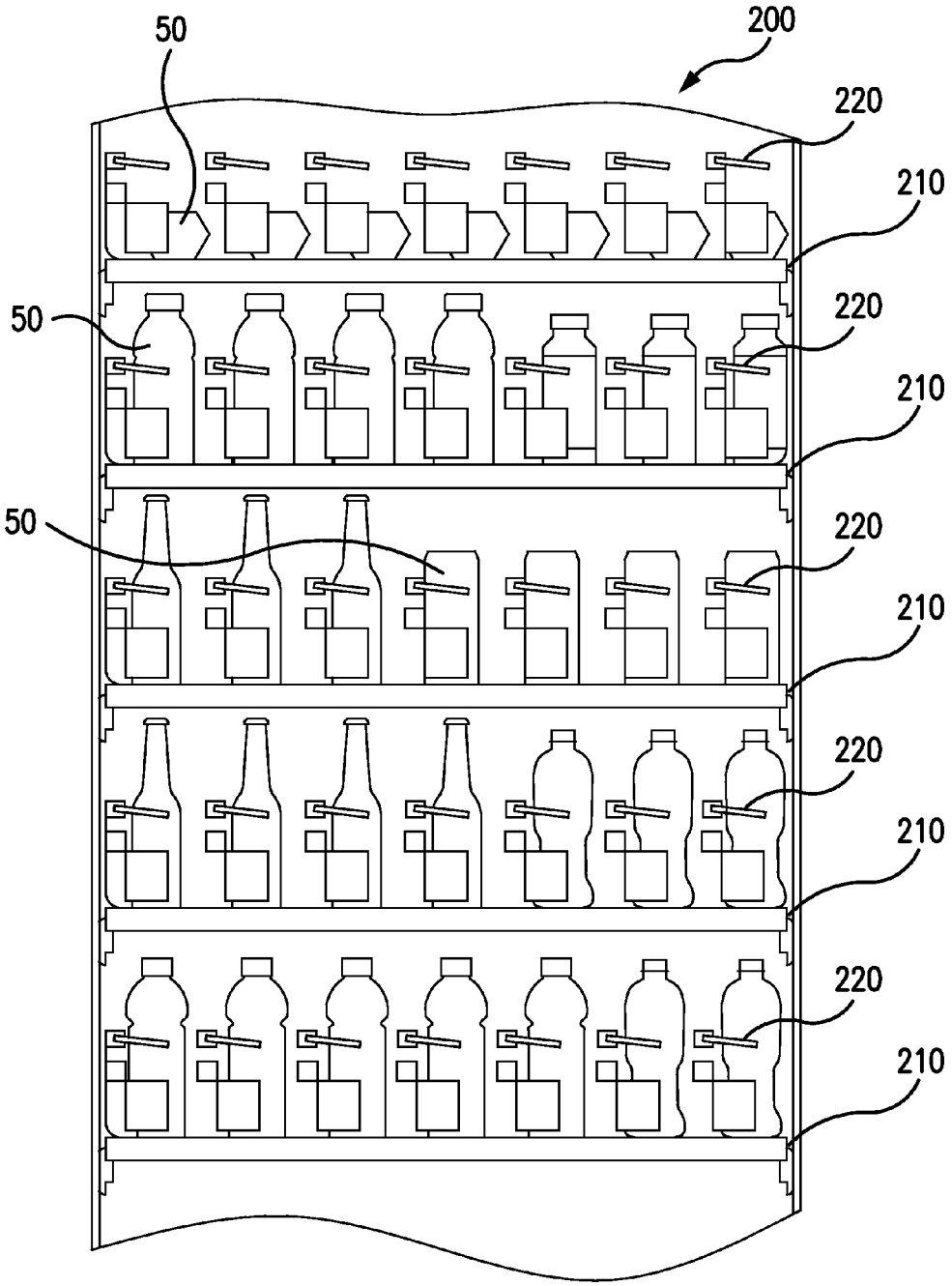
FIG. 2 is a partial front view of a modular vending machine according to various aspects of the invention.

Referring now to FIGS. 1-2, modular vending machine 10 includes a center control module 100, a product storage cabinet 200, and a product storage cabinet 300. Center control module 100 can include a user interface 101 and a product pickup area 402. In one aspect, product storage cabinet 200 can be refrigerated and can include products 50 within product storage area 202 that require refrigeration. In another aspect, product storage cabinet 300 can be non-refrigerated and can include products 51 within product storage area 302 that do not require refrigeration. The configuration of a refrigerated product storage cabinet 200 and a non-refrigerated product storage cabinet 300 can make it possible to have a vending machine with a larger storage capacity with various products having different temperature requirements.

Figure 3:
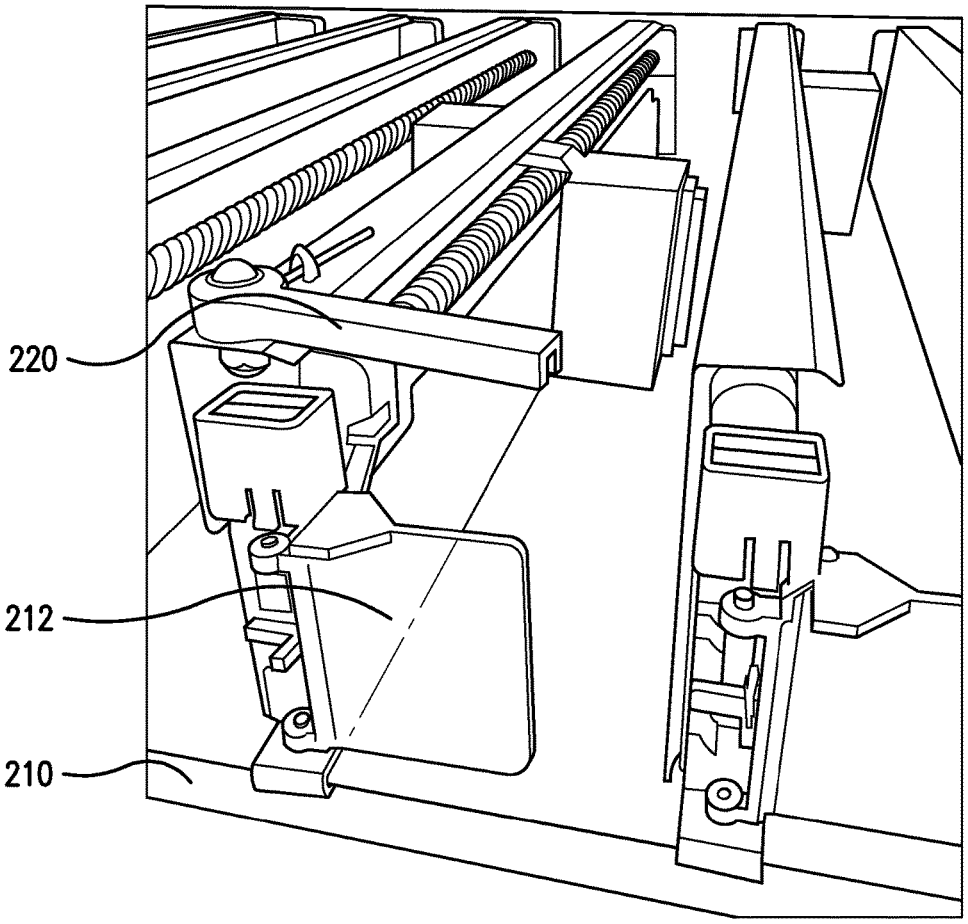
FIG. 3 is a perspective front view of a modular vending machine storage shelf according to various aspects of the invention.

In some embodiments, a product positioner 220 can be attached onto each row of each shelf 210. In one aspect, the product positioner 220 can be attached on one side wall of the shelf gate 212, as shown in FIG. 3. As the product 50 travels from shelf 210 to product transport mechanism 230 (FIG. 5), product positioner 220 can orient product 50 such that the bottom of product 52 is oriented closed to the product pickup area 402 of the central control module 100 and the top of the product 54 is oriented furthest away from the product pickup area 402 (FIG. 9). This way, the product 50 can be travel into the product pickup area 402 bottom first, so it can be oriented vertically in product pickup area 402.

Figure 4:
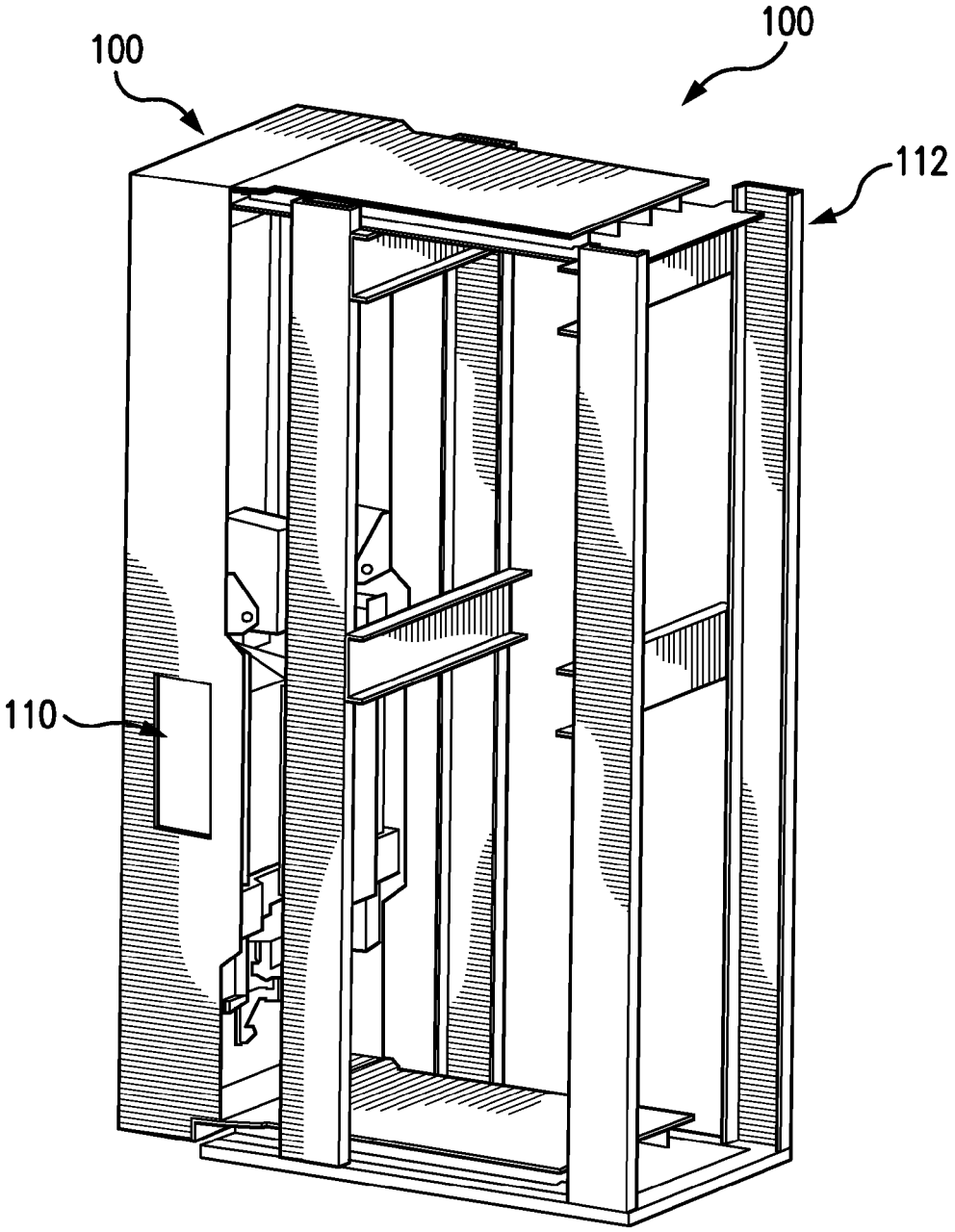
FIG. 4 is a perspective view of a modular vending machine control module according to various aspects of the invention.

As shown in FIG. 4, control module 100 can include a control module chassis 112. Product storage cabinet 200 can attach to a first portion of control module chassis 112 on a first side of control module 100. Product storage cabinet 300 can attach to a second portion of control module chassis 112 on a second side of control module 100. Control module 100 can include a product transport opening 110 in the side wall of control module 100 adjacent product storage cabinet 200. Control module 100 can include a product transport opening 111 in the side wall of control module 100 adjacent products storage cabinet 300. Product transport openings 110 and 111 allow products to be transported from product storage cabinet 200 and product storage cabinet 300 into pickup area 402 in control module 100. In another aspect of the invention, product storage cabinet 200 and/or product storage cabinet 300 can include a product pickup area.

In an aspect of the invention, the parts and components within product storage cabinet 300 can be identical to those in product storage cabinet 200. And because product storage cabinet 300 is positioned on the opposite side of control module 100, the parts and components within product storage cabinet 300 can be reciprocal in function to those in product storage cabinet 200. For example, while products in product storage cabinet 200 move from right to left toward control module 100, products in product storage cabinet 300 move from left to right toward control module 100.

In another aspect of the invention, product storage cabinets 200 and 300 can include similar and/or different parts and components. For example, product storage cabinet 200 and/or product storage cabinet 300 can include a product delivery system including an elevation system, an x-y mechanism, and/or a drop system.

Product storage cabinet 200 can include a front portion 204 and a rear portion 202. Product storage cabinet 200 can include a refrigeration system 80 to maintain a desired temperature within product storage area 202. Product storage cabinet 200 can include a plurality of shelves 210 and a plurality of vend mechanisms 214 attached to shelves 210 to dispense products onto product transport mechanism 230. In some embodiments, vend mechanisms 214 can be a spiral or corkscrew shaped motorized wire that can rotate one full turn in order to dispense a single product 50 from the product storage cabinet in response to a user input. In another aspect, vend mechanisms 214 dispense products using a push plate and gate mechanism, a motor, a spring, or rely solely on gravity.

Referring now to FIGS. 6-9, upon receiving a user selection on the user interface 101, the electronic control module sends a signal to vertical position drive motor 218 (FIG. 8) to rotate and vertically move product transport mechanism 230 to a vertical position adjacent shelf 210 containing a selected product 50. A vend mechanism 214 can dispense product 50 onto belt 232 of product transport mechanism 230. As product 50 travels onto belt 232, product positioner 220, discussed above, can orient product 50 such that the bottom of product 52 is oriented closed to the product pickup area 402 of the central control module 100 and the top of the product 54 is oriented furthest away from the product pickup area 402.

Belt 232 can be continuous and can be travel around support 234 and pulleys 236 in the direction of control module 100. One of pulleys 236 can be driven by pulley drive motor 237.

Product transport mechanism 230 can include a stationary rear wall 238 that prevents product 50 from dropping toward the front of product storage cabinet 200.

Product transport mechanism 230 can include a hinged ramp 260 on a side closest to shelves 210. After product transport mechanism 230 is positioned in a desired vertical position, hinged ramp drive motor can move hinged ramp linkage 264 attached to hinged ramp 260 to move hinged ramp 260 toward the desired shelf 210 into a delivery position. After product 50 travels from shelf 210 along hinged ramp 260 to belt 232, hinged ramp drive motor can move hinged ramp linkage 264 to position hinged ramp 260 into a vertical position for easier travel within product storage cabinet 200. In another aspect, hinged ramp 260 can maintain the delivery position as product transport mechanism 230 moves within product storage cabinet 200. The hinged ramp drive motor can move hinged ramp linkage 264 to position hinged ramp 260 into the vertical position when product 50 travels on belt 232.

Next, vertical position drive motor 218 can rotate and vertically move product transport mechanism 230 to a vertical position adjacent transfer gate opening 110. Transfer gate 103 can move to an open position allowing access to pickup area 402.

Referring now to FIGS. 10-13, upon receiving a user selection on the user interface 101, the electronic control module sends a signal to vertical position drive motor 318 (FIG. 12) to rotate and vertically move product transport mechanism 330 to a vertical position adjacent shelf 310 containing a selected product 51. A vend mechanism 314 can dispense product 51 onto belt 332 of product transport mechanism 330. As product 51 travels onto belt 332, product positioner 320, discussed above, can orient product 51 such that the bottom of product 53 is oriented closed to the product pickup area 402 of the central control module 100 and the top of the product 55 is oriented furthest away from the product pickup area 402.

Belt 332 can be continuous and can be travel around support 334 and pulleys 336 in the direction of control module 100. One of pulleys 336 can be driven by pulley drive motor 337.

Product transport mechanism can include a stationary rear wall 338 that prevents product 51 from dropping toward the front of product storage cabinet 300.

Product transport mechanism 330 can include a hinged ramp 360 on a side closest to shelves 310. After product transport mechanism 330 is positioned in a desired vertical position, hinged ramp drive motor can move hinged ramp linkage 364 attached to hinged ramp 360 to move hinged ramp 360 toward the desired shelf 310 into a delivery position. After product 51 travels from shelf 310 along hinged ramp 360 to belt 332, hinged ramp drive motor can move hinged ramp linkage 364 to position hinged ramp 360 into a vertical position for easier travel within product storage cabinet 300. In another aspect, hinged ramp 360 can maintain the delivery position as product transport mechanism 330 moves within product storage cabinet 300. The hinged ramp drive motor can move hinged ramp linkage 364 to position hinged ramp 360 into the vertical position when product 51 travels on belt 332.

Next, vertical position drive motor 318 can rotate and vertically move product transport mechanism 330 to a vertical position adjacent transfer gate 105. Transfer gate 105 can move to an open position allowing access to pickup area 402.

As shown in FIGS. 14-17, product orientation mechanism 410 can include a drawbridge 412, a control arm 414, a motorized slider 416, a first pivot 417, and a second pivot 418 (FIG. 17). Once product transport mechanism 230 is positioned in a vertical delivery position adjacent transfer gate opening 110, motorized slider 416 can move to move control arm 414 which in turn moves drawbridge 412 to a transfer position (FIGS. 14-15). In the transfer position, drawbridge 412 allows product 50 to travel from product transport mechanism 230, across the gap between control module 100 and product storage cabinet 200, into pickup area 402. For example, after drawbridge is placed in a transfer position, pulley drive motor 237 can rotate to move product 50 through transfer gate opening 110, along drawbridge 412 into pickup area 402. Once product 50 is in pickup area 402, motorized slider 416 can move to move control arm 414 which in turn moves drawbridge 412 into an orientation position to vertically orient product 50 in pickup area 402 (FIG. 17).

In an aspect, product orientation mechanism 420 can include the same components and can operate in the same manner as product orientation mechanism 410. For example, product orientation mechanism 420 can include a drawbridge, a control arm, a motorized slider, a first pivot, and a second pivot (not shown). Once product transport mechanism 330 is positioned in a vertical delivery position adjacent transfer gate 105, the motorized slider can move to move the control arm which in turn moves the drawbridge to a transfer position. In the transfer position, the drawbridge allows product 51 to travel from product transport mechanism 330, across the gap between control module 100 and product storage cabinet 300, into pickup area 402. For example, after drawbridge is placed in a transfer position, pulley drive motor 337 can rotate to move product 51 through transfer gate 105, along the drawbridge and into pickup area 402. Once product 51 is in pickup area 402, the motorized slider can move to move the control arm which in turn moves the drawbridge into an orientation position to vertically orient product 51 in pickup area 402.

In an aspect, sensors 270 can be attached to a bracket to determine whether product 50 has traveled through product transport opening 110 into pickup area 402 (i.e., a sensor 270 can sense the presence or absence of product 50 on belt 232). In some embodiments, sensor 270 can include an ultrasound sensor, an optical sensor, or a pressure sensor.

In some embodiments, pickup area 402 can sense when product 50 has been removed from pickup area 402 (e.g., via sensor 502, such as an ultrasound sensor, an optical sensor, or a pressure sensor).

In an aspect, pickup area 402 can include a first pocket 404 to receive a product from product storage cabinet 200 and a second pocket 406 to receive a product from product cabinet 300 (FIG. 15). First pocket 404 and second pocket 406 can be separated by divider 405.

Control module 100 can include a pickup area door 120 to cover pickup area 402. Drive motor 126 can move linkages 122 and 124 to move pickup area door 120 vertically to allow a user access to pickup area 402. Pickup area door can include a locking mechanism 150 (FIG. 21). Lock mechanism 150 can include a tension spring 152, a locking pawl 154, linkage 156, and solenoid 158 to prevent unauthorized access to pickup area 402.

Modular vending machine 10 can be controlled by an electronic control module that includes a programmable microprocessor that sends an electronic signal to position and initiate the product transport mechanisms 230 and 330 and product orientation mechanisms 410 and 420. The electronic control module can provide intelligent control of the modular vending machine system. The electronic control module can control the vertical position of product transport mechanisms 230 and 330 through control of drive motors 218 and 318. The electronic control module can send a signal to drive motors 218 and 318 to move product transport mechanisms 230 and 330 to respective vertical positions adjacent a shelf of a selected product 50.

The electronic control module can control the horizontal position of belts 232 and 332 through control of drive motors 237 and 337. The electronic control module can send a signal to drive motors 237 and 337 to move products 50 on product transport mechanisms 230 and 330 toward the pickup area 402 in control module 100.

The electronic control module can control the position of hinged ramps 260 and 360 through control of drive motors 262 and 362. The electronic control module can send a signal to drive motors 262 and 362 to move linkages 264 and 364 to move hinged ramps 260 and 360 into a product transport position.

The electronic control module can control the position of the drawbridges, e.g. drawbridge 412, in product orientation mechanisms 410 and 420, respectively, through control of the motorized sliders. The electronic control module can send a signal to the motorized sliders, e.g., motorized slider 416 to move vertically along the control module. The movement of the motorized sliders moves the control arms, e.g., control arm 414, which in turn moves the drawbridges between the transfer position and the pickup position.

The electronic control module can control the position of pickup area door 120 through control of drive motor 126. The electronic control module can send a signal to drive motor 126 to move linkages 122 and 124, which in turn move pickup area door vertically between an open position and a closed position.

The electronic control module can control the position of transfer gates 103 and 105 (FIG. 19) through control of transfer gate drives 102 and 104. The electronic control module can send a signal to transfer gate drives 102 and 104 which in turn move transfer gates 103 and 105 between an open position and a closed position.

The manner in which a user engages the interface of the beverage dispensing system to select and/or dispense a beverage can vary. FIG. 23 illustrates an example method for dispensing an available product according to one aspect of the invention.

At step 2301, an input screen may be displayed on a user interface 101 on control module 100. This may include displaying an initial user input selection (e.g., "touch to start"). In one aspect of the invention, the user interface 101 can display an input screen having a beverage input, a food input, and a combination input. The beverage input can present a number of available beverage product to the user. The food input can present the number of food item products to the user. The combination input can present a number of pre-programmed food and beverage combinations to the user.

At step 2303, a selection of a type or brand of product may be received via input from the user. For example, a user may select a beverage, a food, or a combination beverage and food.

At step 2304, based on the user input in step 2303, the user interface 101 can prompt the user to make a second product selection. For example, if in step 2303 the user selected a beverage, user interface 101 can allow the user to select a food. Alternatively, if the user selected a food, user interface 101 can prompt the user to select a beverage. In another aspect, a user can select three or more products on user interface 101. In a further aspect, a user can select four or more products on user interface 101.

In another aspect, user interface 101 can hide products that have been vended out, i.e., there are no products left in the machine. For example, user interface 101 can hide single products and/or combination products. Alternatively, if a vended out product is selected by the user, the user interface 101 can display a message indicating that the product is unavailable.

At step 2305, a selection of a second type or brand of product may be received via input from the user. For example, a user may select a beverage or a food based on the prompt in step 2304. In another aspect, a user can decline to select a second product and the system can move to step 2306.

At step 2306, based on the user input in step 2303, an electronic control module can send a signal to a motor in a first product transport mechanism (e.g., vertical position drive motor 218 in product transport mechanism 230) to vertically position the first product transport mechanism to receive the first selected product.

At step 2307, based on the user input in step 2305, an electronic control module can send a signal to a motor in a second product transport mechanism (e.g., vertical position drive motor 318 in product transport mechanism 330) to vertically position the second product transport mechanism to receive the second selected product.

At step 2309, the vending machine can transport the first product into the pickup area. For example, the electronic control module can send electronic signal to drive motor 262 to move linkage 264 to move hinged ramp 260 into a product transport position. The electronic control module can then send an electronic signal to dispense product 50 from shelf 210 so product 50 can travel along hinged ramp 260 onto belt 232 on product transport mechanism 230. After product 50 travels onto belt 232, the electronic control module can send an electronic signal to drive motor 262 to move linkage 264 to move hinged ramp 260 to a vertical position. The electronic control module can send an electronic control signal to vertical position drive motor 218 (FIG. 8) to rotate and vertically move product transport mechanism 230 to a vertical position adjacent gate 250. The electronic control module can send a signal to transfer gate drive 102 to move transfer gate 103 to an open position. The electronic control module can also send an electronic signal to drive motor 237 to move product 50 on product transport mechanism 230 through gate 250 and transfer gate 103 toward the pickup area 402 in control module 100. The electronic control module can send a signal to motorized slider 416 to move vertically along the control module to move drawbridge 412 into a transfer position so product 50 can travel along drawbridge 412. The electronic control module can also send a signal to drive motor 126 to move linkages 122 and 124, which in turn move pickup area door vertically to an open position.

At step 2311, the vending machine can transport the second product into the pickup area. For example, the electronic control module can send electronic signal to drive motor 362 to move linkage 364 to move hinged ramp 360 into a product transport position. The electronic control module can then send an electronic signal to dispense product 51 from shelf 310 so product 51 can travel along hinged ramp 360 onto belt 332 on product transport mechanism 330. After product 51 travels onto belt 332, the electronic control module can send an electronic signal to drive motor 362 to move linkage 364 to move hinged ramp 360 to a vertical position. The electronic control module can send an electronic control signal to vertical position drive motor 318 (FIG. 12) to rotate and vertically move product transport mechanism 330 to a vertical position adjacent gate 350. The electronic control module can send a signal to transfer gate drive 104 to move transfer gate 105 to an open position. The electronic control module can also send an electronic signal to drive motor 337 to move product 51 on product transport mechanism 330 through gate 350 and transfer gate 105 toward the pickup area 402 in control module 100. The electronic control module can send a signal to motorized slider 426 to move vertically along the control module to move drawbridge 422 into a transfer position so product 50 can travel along drawbridge 422.

Although the example method of FIG. 23 shows a particular order of steps, the exact order of the above steps could change (e.g., step 2305 could occur prior to step 2303), and the modular vending machine could receive additional input from the user before, after, and in between particular steps of the above example method. The order of the steps and/or what input is received during the course of a user's interaction with the vending machine may be dependent on the organization of the user interface.

In another aspect, at step 2301 user interface 101 can display product videos. The product videos can be pictures of pre-combined products options such as one snack/food product and one beverage product. At step 2303, a consumer can touch or press on the picture of any combined products. Based on the consumer input at step 2303, at step 2304 the user interface will stop the video and show the product selection page with the selected combined products shown on user interface 101 and each product listed along with production information. The product information can include nutritional information, e.g., calories, and product price. The consumer can then proceed with making a payment or can change the selection of products. For example, the consumer can remove one or more of the selected products. The consumer can also add additional products before paying for the items.

In a further aspect, if any product in a pre-combined product option has been vended out, (i.e. no more products are left in the machine), this pre-combined production option will not be shown on the video. The pre-combined product option will also not be shown in the list of available combinations on the user interface.

In another aspect, the dispensing mechanisms in product storage cabinets 200 and 300 can operate simultaneously to reduce the total transaction time. For example, steps 2306, 2307, 2309, and 2311 can occur simultaneously to deliver products 50 and 51 to product pickup area 402 at the same time. In a further aspect, the dispensing mechanisms in each of product storage cabinets 200 and/or 300 can operate simultaneously to reduce the total transaction time. For example, gate 250 and/or transfer gate 103 can be opened as product transport mechanism 230 travels vertically. In addition, gate 350 and/or transfer gate 105 can be opened as product transport mechanism 330 travels vertically.

FIG. 24 illustrates a block diagram of an example communication network in which one or more embodiments may be implemented. A vending machine, e.g., modular vending machine 10, can be configured to dispense a product according to a user's selection. For example, a user can approach a vending machine 2404, and interact with the vending machine 2404 to make a selection (e.g., input a code or press a button corresponding to the desired product). In response, the vending machine 2404 may dispense the selected product. In general, examples of this disclosure relate to a modular vending machine; however, various aspects of this disclosure could be used in a dispenser for other types of products (e.g., electronics or other consumer goods).

Vending machines may be located across different locations or premises. For example, FIG. 24 illustrates three vending machines: vending machine 2404, vending machine 2406 and vending machine 2408.

In a further aspect, vending machines may be connected to a controller. A controller may be centrally located and/or a separate controller may be incorporated into each vending machine. As illustrated in FIG. 24, vending machines 2406 and 2408 are connected to controller 2405. Controller 2405 can be configured to receive instructions from vending machine 2406 and/or 2408, and to cause the appropriate vending machine to dispense a selected product. For example, a user may interact with vending machine 2406 to select a product (e.g., via a touchpad, touch screen, keypad, etc.), instructions for the selected product may be transmitted to controller 2405, and controller 2405 may be configured to dispense a selected product in response to the instructions.

Components of a vending machine may include a processor 2420, memory 2430, software 2440, and/or additional components suitable for implementing the functions and methods of the vending machine. Software 2440 may be stored in computer-readable memory 2430 such as read only or random access memory in vending machine 2404 and may include instructions that cause one or more components (e.g., processor 2420, display, etc.) of a vending machine (e.g., vending machine 2404) to perform various functions and methods including those described herein.

A vending machine may communicate with other devices using one or more networks. For example, as illustrated in FIG. 24, vending machines 2404, 2406 and 2408 may communicate with server 2400 via network 2402 and/or network 2403. Network 2402 and network 2403 may include multiple networks that are interlinked so as to provide internetworked communications. Such networks may include one or more private or public packet-switched networks (e.g., the Internet), one or more private or public circuit-switched networks (e.g., a public switched telephone network), a cellular network, a short or medium range wireless communication connection (e.g., Bluetooth®, ultra wideband (UWB), infrared, WiBree, wireless local area network (WLAN) according to one or more versions of Institute of Electrical and Electronics Engineers (IEEE) standard no. 802.11), or any other suitable network. Devices in communication with each other (e.g., vending machines 2404, 2406, and 2408, server 2400, and/or data repository 2401) may use various communication protocols such as Internet Protocol (IP), Transmission Control Protocol (TCP), Simple Mail Transfer Protocol (SMTP), File Transfer Protocol (FTP), among others known in the art.

Server 2400, controller 2405, and vending machines 2404, 2406 and 2408 may be configured to interact with each other and other devices. In one example, vending machine 2404 may include software 2440 that is configured to coordinate the transmission and reception of information to and from server 2400. In one arrangement, software 2440 may include application or server specific protocols for requesting and receiving data from server 2400. For example, software 2440 may comprise a browser or variants thereof and server 2400 may comprise a web server. In some arrangements, server 2400 may transmit application data to vending machines, such as software updates to various components of the dispensing system (e.g., updates to the user interface, updates to firmware of the vending machines, updates to drivers of the vending machines, etc.). In one or more arrangements, server 2400 may receive data from the vending machines, such as data describing the current stock of the vending machine (e.g., a listing of products and the number remaining at the vending machine), operation history and/or usage metrics of the vending machine (e.g. counters tracking the selections of users of the machine), status of the vending machine (e.g., whether any components are working improperly), etc. Server 2400 may be configured to access and store data in data repository 2401, such as data that it receives and transmits in data repository 2401. Data repository 2401 may also include other data accessible to server 2400, such as different drink recipes that can be downloaded to vending machines.

FIG. 22 illustrates an example computing device on which at least some of the various elements described herein can be implemented, including, but not limited to, various components of vending machines (e.g., vending machines 2404, 2406 and 2408, modular vending machine 10). Computing device 2200 may include one or more processors 2201, which may execute instructions of a computer program to perform, or cause to perform, any of the steps or functions described herein. The instructions may be stored in any type of computer-readable medium or memory, to configure the operation of the processor 2201. For example, instructions may be stored in a read-only memory (ROM) 2202, random access memory (RAM) 2203, removable media 2204, such as a Universal Serial Bus (USB) drive, compact disk (CD) or digital versatile disk (DVD), floppy disk drive, flash card, or any other desired electronic storage medium. Instructions may also be stored in an attached (or internal) hard drive 2205.

Computing device 2200 may include one or more output devices, such as a display 2206, and may include one or more output device controllers 2207, such as a video processor. A controller may be centrally located, for example in center control module 100. In another aspect, a separate controller may be incorporated into each product storage cabinet.

There may also be one or more user input devices 2208, such as a touch screen, remote control, keyboard, mouse, microphone, card reader, RFID reader, etc. The computing device 2200 may also include one or more network interfaces, such as input/output circuits 2209 to communicate with an external network 2210. The network interface may be a wired interface, wireless interface, or a combination of the two. In some embodiments, the interface 2209 may include a modem (e.g., a cable modem), and network 2210 may include the communication lines of the networks illustrated in FIG. 24, or any other desired network.

The FIG. 22 example is an illustrative hardware configuration. Modifications may be made to add, remove, combine, divide, etc. components as desired. Additionally, the components illustrated may be implemented using basic computing devices and components, and the same components (e.g., processor 2201, storage 2202, user input device 2208, etc.) may be used to implement any of the other computing devices and components described herein.

One or more aspects of the disclosure may be embodied in a computer-usable data and/or computer-executable instructions, such as in one or more program modules, executed by one or more computers or other devices. Generally, program modules include routines, programs, objects, components, data structures, etc. that perform particular tasks or implement particular abstract data types when executed by a processor in a computer or other data processing device. The computer executable instructions may be stored on one or more computer readable media such as a hard disk, optical disk, removable storage media, solid state memory, RAM, etc. The functionality of the program modules may be combined or distributed as desired in various embodiments. In addition, the functionality may be embodied in whole or in part in firmware or hardware equivalents such as integrated circuits, field programmable gate arrays (FPGA), controllers, application-specific integrated circuits (ASICS), combinations of hardware/firmware/software, and the like. Particular data structures may be used to more effectively implement one or more aspects of the invention, and such data structures are contemplated within the scope of computer executable instructions and computer-usable data described herein.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

What is claimed is:

1. A product dispenser comprising:

a central module including a user interface and a product pickup area;

a first product storage cabinet including a first plurality of product shelves positioned within a first interior area;

a second product storage cabinet including a second plurality of product shelves positioned within a second interior area;

a first product transport mechanism positioned within the first interior area to receive a first product from one of the first plurality of product shelves in the first product storage cabinet and deliver the first product to the product pickup area;

a first product orientation mechanism to orient the first product in the product pickup area in a vertically upright orientation, the first product orientation mechanism having a transfer position where a bridge of the first product orientation mechanism spans a space between the product pickup area and the first product transport mechanism, the first product orientation mechanism having an orientation position where a portion of the bridge extends into an interior area of the product pickup area to orient the first product into a vertically upright orientation; and a second product transport mechanism positioned within the second interior area to receive a second product from one of the second plurality of product shelves in the second product storage cabinet and deliver the second product to the product pickup area.

2. The product dispenser of claim 1, wherein the first product orientation mechanism includes a first pivot connecting the portion to the product pickup area, a second pivot connecting a control arm to the portion, and a third pivot connecting the control arm to a motorized slider.

3. The product dispenser of claim 1, further comprising a second product orientation mechanism to orient the second product in the product pickup area in a vertically upright orientation.

4. The product dispenser of claim 3, wherein the second product orientation mechanism has a transfer position where a portion of the second product orientation mechanism spans a space between the product pickup area and the second product transport mechanism, and wherein the second product orientation mechanism has a pickup position where the portion of the second product orientation mechanism extends into the product pickup area to orient the second product.

5. The product dispenser of claim 1, further comprising a first product positioner to orient the first product onto the first product transport mechanism such that a bottom of the first product is positioned closer to the central module than a top portion of the first product.

6. The product dispenser of claim 5, further comprising a second product positioner to orient the second product onto the second product transport mechanism such that a bottom of the second product is positioned closer to the central module than a top portion of the second product.

7. The product dispenser of claim 6, wherein the first product positioner is attached to one of the first plurality of product shelves in the first product storage cabinet, and wherein the second product positioner is attached to one of the second plurality of product shelves in the second product storage cabinet.

8. The product dispenser of claim 6, wherein the first product positioner and the second product positioner are non-motorized.

9. A product dispenser comprising:

a central module including a user interface and a product pickup area;

a first product storage cabinet including a first plurality of product shelves positioned within a first interior area;

a first product transport mechanism positioned within the first interior area to receive a first product from one of the first plurality of product shelves in the first product storage cabinet and deliver the first product to the product pickup area; and a first product orientation mechanism to orient the first product in the product pickup area in a vertically upright orientation, the first product orientation mechanism having an orientation position where a portion of a bridge of the first product orientation mechanism extends into an interior area of the product pickup area to orient the first product into a vertically upright orientation.

10. The product dispenser of claim 9, wherein the first product orientation mechanism has a transfer position where a portion of the first product orientation mechanism spans a space between the product pickup area and the first product transport mechanism.

11. The product dispenser of claim 9, wherein the first product orientation mechanism includes a first pivot connecting the portion to the product pickup area, a second pivot connecting a control arm to the portion, and a third pivot connecting the control arm to a motorized slider.

12. A method for dispensing a product, comprising:

transmitting a first electronic signal to a control system based on a first user selection on an electronic user interface;

moving a first product transport mechanism into a first vertical position to receive a first product from a first storage shelf based on the first electronic signal;

moving the first product transport mechanism into a first vertical delivery position to deliver the first product into a pickup area;

moving a first product orientation mechanism into a transfer position to receive the first product from the first product transport mechanism;

moving the first product into the pickup area;

moving the first product orientation mechanism into an orientation position wherein a portion of a bridge of the first product orientation mechanism extends into an interior area of the pickup area to orient the first product in a vertically upright orientation in the pickup area.

13. The method of claim 12, further comprising:

transmitting a second electronic signal to the control system based on a second user selection on the electronic user interface;

moving a second product transport mechanism into a second vertical position to receive a second product from a second storage shelf based on the second electronic signal;

moving the second product transport mechanism into a second vertical delivery position to deliver the second product into the pickup area;

moving a second product orientation mechanism into a transfer position to receive the second product from the second product transport mechanism; and moving the second product into the pickup area.

14. The method of claim 13, further comprising:

moving the second product orientation mechanism into a pickup position to orient the second product in a vertically upright orientation in the pickup area.

* * * * *